US005907314A

United States Patent [19]

Negishi et al.

[11] Patent Number: 5,907,314

[45] Date of Patent: May 25, 1999

[54] LIQUID-CRYSTAL DISPLAY APPARATUS

[75] Inventors: Ichiro Negishi, Yokosuka; Tsutou Asakura, Odawara; Masato Furuya, Yokosuka; Yuji Uchiyama, Chigasaki; Hiroyuki Bonde, Yokohama, all of Japan

[73] Assignee: Victor Company of Japan, Ltd., Yokohama, Japan

[21] Appl. No.: 08/739,283

[22] Filed: Oct. 29, 1996

[30] Foreign Application Priority Data

Oct. 31, 1995 [JP] Japan ..... 7-283888

[51] Int. Cl.[6] ..... G09G 3/36

[52] U.S. Cl. ..... 345/103; 345/100; 345/87

[58] Field of Search ..... 345/100, 103, 345/98, 96; 349/33, 34, 39, 42

[56] References Cited

U.S. PATENT DOCUMENTS

| | | | |
|---|---|---|---|
| 4,842,371 | 6/1989 | Yasuda et al. | 345/103 |
| 5,041,821 | 8/1991 | Onistsuka et al. | 345/101 |
| 5,136,282 | 8/1992 | Inaba et al. | 345/97 |
| 5,376,944 | 12/1994 | Mogi et al. | 345/100 |
| 5,392,058 | 2/1995 | Tagawa | 345/104 |
| 5,465,102 | 11/1995 | Usui et al. | 345/89 |
| 5,512,915 | 4/1996 | Lerox | 345/98 |
| 5,528,256 | 6/1996 | Erhart et al. | 345/96 |

FOREIGN PATENT DOCUMENTS 4067192 10/1992 Japan .

*Primary Examiner*—Chanh Nguyen
*Assistant Examiner*—Alecia Nelson
*Attorney, Agent, or Firm*—Pollock, Vande Sande & Amernick

[57] ABSTRACT

A liquid-crystal display apparatus includes a layer of liquid crystal. A matrix array is composed of scanning electrodes and signal electrodes. The scanning electrodes extend along a matrix row direction. The signal electrodes extend along a matrix column direction. Switching circuit elements are located at respective places where the scanning electrodes intersect with the signal electrodes. Pixel electrodes connected to the switching circuit elements are operative for controlling portions of the liquid-crystal layer respectively. A first device is operative for driving the scanning electrodes. A second device is operative for delaying a first video signal into a second video signal. A third device is operative for alternately selecting one out of the first video signal and the second video signal to generate a third video signal in response to the first video signal and the second video signal. A fourth device is operative for periodically inverting a polarity of the third video signal at a timing synchronous with alternately selecting by the third device to convert the third video signal into a fourth video signal. A fifth device is operative for feeding the fourth video signal to the signal electrodes.

4 Claims, 14 Drawing Sheets

LIQUID-CRYSTAL DISPLAY APPARATUS

BACKGROUND OF THE INVENTION

Field of the Invention

This invention relates to a liquid-crystal display apparatus including a liquid-crystal display panel of the active matrix type.

Description of the Prior Art

Some liquid-crystal display apparatuses have a matrix array of 1-pixel-corresponding cells. These cells include different 1-pixel-corresponding areas of a liquid-crystal layer, respectively. Each of the cells further include a storage segment, and a switching transistor connected to the storage segment. The storage segment of each cell can be accessed via the related switching transistor. Scanning circuits control the switching transistors in the cells, and thereby sequentially write 1-pixel-corresponding segments of a video signal into the storage segments of the cells, respectively. In each cell, the storage segment continuously subjects the 1-pixel-corresponding area of the liquid-crystal layer to a signal voltage (an electric field) depending on the 1-pixel-corresponding segment of the video signal. Accordingly, light in the 1-pixel-corresponding area of the liquid-crystal layer is modulated with the 1-pixel-corresponding segment of the video signal.

Japanese published examined patent application 4-67192 discloses such a liquid-crystal display apparatus. In the display apparatus of Japanese application 4-67192, the polarity of an applied video signal is inverted in every field. Thus, the polarity of the video signal during each odd-numbered field is opposite to that during each even-numbered field. Accordingly, in the case where a field frequency is 60 Hz, a liquid-crystal layer is driven at a frequency of 30 Hz. In this case, the brightness of an indicated picture changes every field so that the indicated picture tends to flicker.

SUMMARY OF THE INVENTION

It is an object of this invention to provide an improved liquid-crystal display apparatus.

A first aspect of this invention provides a liquid-crystal display apparatus comprising a layer of liquid crystal; a matrix array of scanning electrode and signal electrodes, the scanning electrodes extending along a matrix row direction, the signal electrodes extending along a matrix column direction; switching circuit elements located at respective places where the scanning electrodes intersect with the signal electrodes; pixel electrodes connected to the switching circuit elements for controlling portions of the liquid-crystal layer respectively; first means for driving the scanning electrodes; second means for delaying a first video signal into a second video signal; third means for alternately selecting one out of the first video signal and the second video signal to generate a third video signal in response to the first video signal and the second video signal; fourth means for periodically inverting a polarity of the third video signal at a timing synchronous with said alternately selecting by the third means to convert the third video signal into a fourth video signal; and fifth means for feeding the fourth video signal to the signal electrodes.

A second aspect of this invention provides a liquid-crystal display apparatus comprising a layer of liquid crystal; a matrix array of scanning electrode and signal electrodes, the scanning electrodes extending along a matrix row direction, the signal electrodes extending along a matrix column direction, the signal electrodes being separated into a first group located in an upper half of the matrix array and a second group located in a lower half of the matrix array; switching circuit elements located at respective places where the scanning electrodes intersect with the signal electrodes; pixel electrodes connected to the switching circuit elements for controlling portions of the liquid-crystal layer respectively; first means for driving the scanning electrodes; second means for delaying a first video signal into a second video signal; third means for alternately selecting one out of the first video signal and the second video signal for every half field to generate a third video signal in response to the first video signal and the second video signal; fourth means for alternately selecting one out of the first video signal and the second video signal for every half field to generate a fourth video signal in response to the first video signal and the second video signal, the fourth means being operative to select the first video signal when the third means selects the second video signal, and to select the second video signal when the third means selects the first video signal; fifth means for periodically inverting a polarity of the third video signal at a timing synchronous with said alternately selecting by the third means to convert the third video signal into a fifth video signal; sixth means for periodically inverting a polarity of the fourth video signal at a timing synchronous with said alternately selecting by the fourth means to convert the fourth video signal into a sixth video signal; seventh means for feeding the fifth video signal to the signal electrodes in the first group; and eighth means for feeding the sixth video signal to the signal electrodes in the second group.

A third aspect of this invention is based on the first aspect thereof, and provides a liquid-crystal display apparatus wherein the second means comprises a memory having a capacity corresponding to a half of the total number of the pixel electrodes.

A fourth aspect of this invention is based on the first aspect thereof, and provides a liquid-crystal display apparatus further comprising a dielectric mirror located between the liquid-crystal layer and the pixel electrodes.

A fifth aspect of this invention provides a liquid-crystal display apparatus comprising a layer of liquid crystal; a matrix array of scanning electrode and signal electrodes, the scanning electrodes extending along a matrix row direction, the signal electrodes extending along a matrix column direction; switching circuit elements located at respective places where the scanning electrodes intersect with the signal electrodes; pixel electrodes connected to the switching circuit elements for controlling portions of the liquid-crystal layer respectively; first means for feeding a video signal, corresponding to a former half of a 1-field interval, to upper halves of the signal electrodes; second means for feeding a video signal, corresponding to a latter half of a 1-field interval, to lower halves of the signal electrodes; third means for making opposite a polarity of the video signal fed by the first means and a polarity of the video signal fed by the second means with respect to each other; fourth means for sequentially driving the scanning electrodes corresponding to the upper halves of the signal electrodes from the uppermost scanning electrode for every half-field interval; and fifth means for sequentially driving the scanning electrodes corresponding to the lower halves of the signal electrodes from the uppermost scanning electrode for every half-field interval.

A sixth aspect of this invention provides a liquid-crystal display apparatus comprising a layer of liquid crystal; a matrix array of scanning electrodes and signal electrodes, the scanning electrodes extending along a matrix row direction, the signal electrodes extending along a matrix column direction; switching circuit elements located at respective places where the scanning electrodes intersect with the signal electrodes; pixel electrodes connected to the switching circuit elements for controlling portions of the liquid-crystal layer respectively; first means for feeding a video signal, corresponding to a former half of a 1-field interval, to upper halves of the signal electrodes; second means for feeding a video signal, corresponding to a latter half of a 1-field interval, to lower halves of the signal electrodes; third means for making opposite a polarity of the video signal fed by the first means and a polarity of the video signal fed by the second means with respect to each other; fourth means for sequentially driving the scanning electrodes corresponding to the upper halves of the signal electrodes from the uppermost scanning electrode for every half-field interval; and fifth means for sequentially driving the scanning electrodes corresponding to the lower halves of the signal electrodes from the uppermost scanning electrode for every half-field interval: the fourth means being operative to, in cases where a video signal corresponding to an even-numbered scanning line is fed to the upper halves of the signal electrodes by the first means, sequentially drive a set having the first scanning electrode and the second scanning electrode, and sets each having an odd-numbered scanning electrode and a next even-numbered scanning electrode; the fifth means being operative to, in cases where a video signal corresponding to an even-numbered scanning line is fed to the lower halves of the signal electrodes by the second means, sequentially drive a set having the first scanning electrode and the second scanning electrode, and sets each having an odd-numbered scanning electrode and a next even-numbered scanning electrode; the fourth means being operative to, in cases where a video signal corresponding to an odd-numbered scanning line is fed to the upper halves of the signal electrodes by the first means, sequentially drive sets each having an even-numbered scanning electrode and a next odd-numbered scanning electrode; the fifth means being operative to, in cases where a video signal corresponding to an odd-numbered scanning line is fed to the lower halves of the signal electrodes by the second means, sequentially drive a set having the first scanning electrode, the second scanning electrode, and the third scanning electrode, and sets each having an even-numbered scanning electrode and a next odd-numbered scanning electrode.

A seventh aspect of this invention provides a liquid-crystal display apparatus comprising a liquid-crystal layer having first and second half areas; first means for, during a former half of a first 1-field time interval, feeding a first video signal segment of a positive polarity to the first half area of the liquid-crystal layer; second means for inverting the first video signal segment of the positive polarity into the first video signal segment of a negative polarity; third means for, during a latter half of the first 1-field time interval, feeding the first video signal segment of the negative polarity to the first half area of the liquid-crystal layer; fourth means for inverting a second video signal of a positive polarity into the second video signal of a negative polarity; fifth means for, during the latter half of the first 1-field time interval, feeding the second video signal segment of the negative polarity to the second half area of the liquid-crystal layer; and sixth means for, during a former half of a second 1-field time interval, feeding the second video signal segment of the positive polarity to the second half area of the liquid-crystal layer.

An eighth aspect of this invention provides a liquid-crystal display apparatus comprising a liquid-crystal layer having first and second half areas; first means for, during a former half of a first 1-field time interval, feeding a first video signal segment of a positive polarity to the first half area of the liquid-crystal layer; second means for inverting the first video signal segment of the positive polarity into the first video signal segment of a negative polarity; third means for, during a latter half of the first 1-field time interval, feeding the first video signal segment of the negative polarity to the first half area of the liquid-crystal layer; fourth means for, during the latter half of the first 1-field time interval, feeding a second video signal segment of a positive polarity to the second half area of the liquid-crystal layer; fifth means for inverting the second video signal segment of the positive polarity into the second video signal segment of a negative polarity; and sixth means for, during a former half of a second 1-field time interval, feeding the second video signal segment of the negative polarity to the second half area of the liquid-crystal layer.

A ninth aspect of this invention provides a liquid-crystal display apparatus comprising a liquid-crystal layer having first and second half areas, the first half area having parallel lines, the second half area having parallel lines; first means for separating the lines in the first half area of the liquid-crystal layer into sets each having one line or two neighboring lines; second means for separating the lines in the first half area of the liquid-crystal layer into sets each having two neighboring lines, wherein the line sets provided by the second means differ from the line sets provided by the first means; third means for separating the lines in the second half area of the liquid-crystal layer into sets each having two neighboring lines; fourth means for separating the lines in the second half area of the liquid-crystal layer into sets each having one line, two neighboring lines, or three neighboring lines, wherein the line sets provided by the fourth means differ from the line sets provided by the third means; fifth means for, during a former half of a first 1-field time interval, sequentially feeding a first video signal segment of a positive polarity to the line sets provided by the first means; sixth means for, during the former half of the first 1-field time interval, sequentially feeding a second video signal segment of a negative polarity to the line sets provided by the third means; seventh means for inverting the first video signal segment of the positive polarity into the first video signal segment of a negative polarity; eighth means for, during a latter half of the first 1-field time interval, sequentially feeding the first video signal segment of the negative polarity to the line sets provided by the first means; ninth means for, during the latter half of the first 1-field time interval, sequentially feeding a third video signal segment of a positive polarity to the line sets provided by the fourth means; tenth means for inverting the third video signal segment of the positive polarity into the third video signal segment of a negative polarity; eleventh means for, during a former half of a second 1-field time interval, sequentially feeding the third video signal segment of the negative polarity to the line sets provided by the fourth means; twelfth means for, during the former half of the second 1-field time interval, sequentially feeding a fourth video signal segment of a positive polarity to the line segments provided by the second means; thirteenth means for causing one of the line sets provided by the third means and one of the line sets provided by the fourth means to contain a first end line among the lines in the second half area of the liquid-crystal layer which adjoins a boundary between the first and second half areas of the liquid-crystal layer so that the first end line continues to be fed with video information represented by the second video signal segment or the third video signal segment; and fourteenth means for causing one of the line sets provided by the first means and one of the line sets provided by the second means to contain a second end line among the lines in the first half area of the liquid-crystal layer which adjoins a boundary between the first and second half areas of the liquid-crystal layer so that the second end line continues to be fed with video information represented by the first video signal segment or the fourth video signal segment.

DESCRIPTION OF THE PREFERRED EMBODIMENTS

A prior-art liquid-crystal display apparatus will be explained for a better understanding of this invention.

Figure 1:
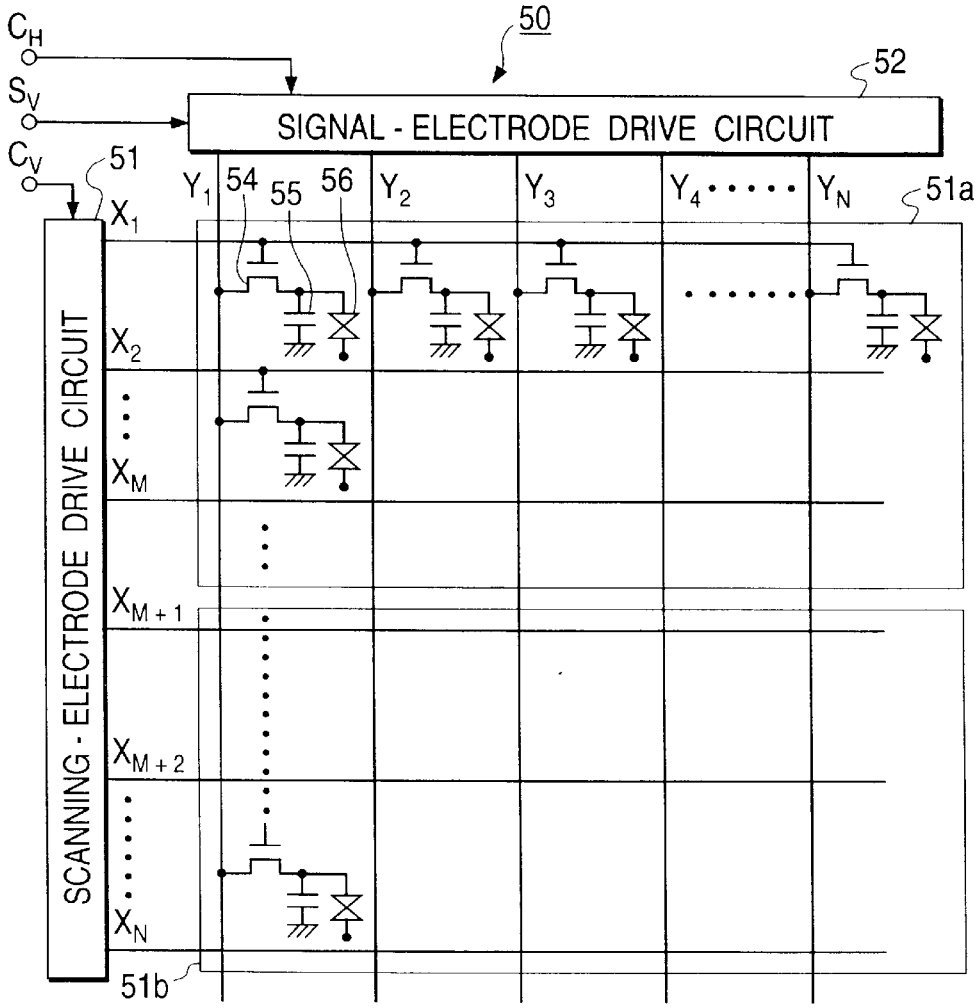
FIG. 1 PRIOR ART
FIG. 1 is a diagram of a prior-art liquid-crystal display apparatus.

With reference to FIG. 1, a prior-art liquid-crystal display apparatus 50 includes a plurality of scanning electrodes $X_1$, $X_2$, . . . ,$X_N$, and a plurality of signal electrodes $Y_1$, $Y_2$, . . . , $Y_N$. The scanning electrodes $X_1$, $X_2$, . . . , $X_N$ and the signal electrodes $Y_1$, $Y_2$, . . . , $Y_N$ are formed on a glass substrate (not shown). The scanning electrodes $X_1$, $X_2$, . . . , $X_N$ extend along rows. The signal electrodes $Y_1$, $Y_2$, . . . , $Y_N$ extend along columns.

In the prior-art apparatus 50 of FIG. 1, segments of a matrix where the scanning electrodes $X_1$, $X_2$, . . . , $X_N$ and the signal electrodes $Y_1$, $Y_2$, . . . , $Y_N$ intersect with each other have switching transistors 54, respectively. One end of the switching transistors 54 are connected to pixel electrodes respectively. One end of the switching transistors 54 are also connected to capacitors 55 respectively. Each capacitor 55 serves to store a 1-pixel-corresponding segment of a video signal $S_V$. In addition, each capacitor 55 continuously subjects a 1-pixel-corresponding liquid-crystal portion 56 to a signal voltage (an electric field) depending on the 1-pixel-corresponding segment of the video signal $S_V$. The application of the signal voltage (the electric field) to the 1-pixel-corresponding liquid-crystal portion 56 is implemented via the pixel electrode and orientation films (not shown).

The prior-art apparatus 50 of FIG. 1 includes a scanning electrode drive circuit 51 and a signal electrode drive circuit 52. The scanning-electrode drive circuit 51 feeds drive signals to the scanning electrodes $X_1$, $X_2$, . . . , $X_N$ at different timings in response to a scanning-electrode control signal $C_V$, respectively. The signal-electrode drive circuit 52 feeds time segments of the video signal $S_V$ to the signal electrodes $Y_1$, $Y_2$, . . . , $Y_N$ in response to a signal-electrode control signal $C_H$, respectively. A memory (not shown) temporarily holds the video signal $S_V$ before outputting the same to the signal-electrode drive circuit 52.

When the scanning-electrode drive circuit 51 outputs an active drive signal to the scanning electrode $X_1$, the switching transistors 54 connected to the scanning electrode $X_1$ are changed to ON states (conductive states). During this time period, the signal-electrode drive circuit 52 outputs 1-pixel-corresponding segments of the video signal $S_V$ to the signal electrodes $Y_1$, $Y_2$, . . . , $Y_N$ in response to the signal-electrode control signal $C_H$, respectively. The 1-pixel-corresponding segments of the video signal $S_V$ travel to the related capacitors 55 via the ON-state switching transistors 54, respectively. Then, the 1-pixel-corresponding segments of the video signal $S_V$ charge the related capacitors 55 respectively. Thus, the 1-pixel-corresponding segments of the video signal $S_V$ are stored into the related capacitors 55 respectively. In addition, the 1-pixel-corresponding segments of the video signal $S_V$ reach the related pixel electrodes respectively so that signal voltages (electric fields) depending on the 1-pixel-corresponding segments of the video signal $S_V$ are applied to the respective liquid-crystal portions 56 via the orientation films. Portions of light in the liquid-crystal portions 56 are modulated with the 1-pixel-corresponding segments of the video signal $S_V$ respectively. In this way, the liquid-crystal portions 56 in a row (a line) corresponding to the scanning electrode $X_1$ are scanned.

When the active drive signal outputted to the scanning electrode $X_1$ is replaced by an inactive drive signal, the switching transistors 54 connected to the scanning electrode $X_1$ are changed to OFF states (non-conductive states). After the replacement of the active drive signal by the inactive drive signal, the signal voltages depending on the 1-pixel-corresponding segments of the video signal $S_V$ remain applied to the liquid-crystal portions 56 by the capacitors 55 until new 1-pixel-corresponding segments of the video signal $S_V$ are fed.

The scanning-electrode drive circuit 51 sequentially outputs active drive signals to the scanning electrodes $X_1$, $X_2$, . . . , $X_N$ to implement a vertical scanning process. On the other hand, the signal-electrode drive circuit 52 outputs 1-pixel-corresponding segments of the video signal $S_V$ to the signal electrodes $Y_1$, $Y_2$, . . . , $Y_N$ to implement a horizontal scanning process. During every field related to the video signal $S_V$, all the liquid-crystal portions 56 in the matrix are scanned to provide a 1-field indicated picture.

Figure 2:
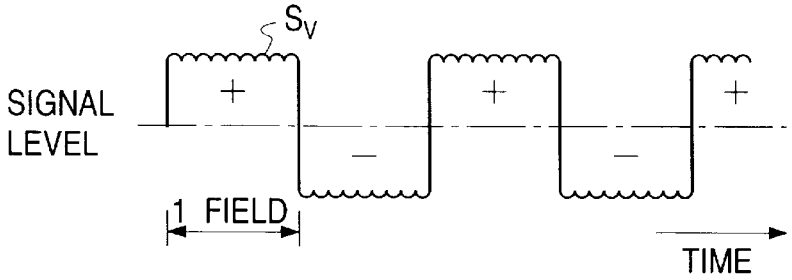
FIG. 2 PRIOR ART
FIG. 2 is a time-domain diagram of a video signal in the prior-art apparatus of FIG. 1.

With reference to FIG. 2, in the prior-art apparatus 50, the polarity of the video signal $S_V$ is inverted in every field. Accordingly, the polarity of the video signal $S_V$ during each odd-numbered field is opposite to that during each even-numbered field. Thus, the matrix of the liquid-crystal portions 56 is driven by an ac voltage having a frequency equal to half the field frequency of the video signal $S_V$.

During time intervals except the video-signal storing intervals, the capacitors 55 tend to be discharged in accordance with leak currents flowing through the liquid-crystal portions 56. Therefore, the effective values of the signal voltages in the capacitors 55 tend to drop as time goes by. The drops in the effective values of the signal voltages darken an indicated picture. The prior-art apparatus 50 of FIG. 1 deals with such a problem as follows. Every 1-field-corresponding segment of the video signal $S_V$ is written into the matrix of the capacitors 55. A buffer register stores the video signal $S_V$ half-field by half-field. When the former half of a present 1-flield-corresponding segment of the video signal $S_V$ is directly written into the upper half of the matrix of the capacitors 55, the latter half of a previous 1-field-corresponding segment of the video signal $S_V$ is written into the lower half of the matrix of the capacitor 55 from the buffer register. When the latter half of the present 1-field-corresponding segment of the video signal $S_V$ is directly written into the lower half of the matrix of the capacitors 55, the former half of the present 1-field-corresponding segment of the video signal $S_V$ is written into the upper half of the matrix of the capacitor 55 from the buffer register. Accordingly, the same 1-field-corresponding segment of the video signal $S_V$ is written into the matrix of the capacitors 55 twice during a 1-field interval.

In the prior-art apparatus 50 of FIG. 1, the matrix is divided into upper and lower halves 51*a* and 51*b* assigned to upper and lower half fields respectively. The upper matrix half 51*a* contains the scanning electrodes $X_1, X_2, \ldots, X_M$. The lower matrix half 51*b* contains the scanning electrodes $X_{M+1}, X_{M+2}, \ldots, X_N$.

It is now assumed that a digital version of the video signal $S_V$ which represents a lower half field is stored in the buffer register. Conditions which occur during the former half of a 1-field interval will be described hereinafter. During a first period, a 1-pixel-corresponding segment of the video signal $S_V$ related to an upper half field is directly fed to the pixel electrode in the upper half matrix 51*a* which corresponds to the scanning electrode $X_1$ and the signal electrode $Y_1$. A digital version of a 1-pixel-corresponding segment of the video signal $S_V$ related to a lower half field is read out from an address $M_{1,1}$ of the buffer register and is converted into an analog version, and the analog version of the 1-pixel-corresponding segment of the video signal $S_V$ is fed to the pixel electrode in the lower half matrix 51*b* which corresponds to the scanning electrode $X_{M+1}$ and the signal electrode $Y_1$. The 1-pixel-corresponding segment of the video signal $S_V$, the same as that fed to the pixel electrode corresponding to the scanning electrode $X_1$ and the signal electrode $Y_1$, is written into the address $M_{1,1}$ of the buffer register to implement an updating process.

During a second period, a subsequent 1-pixel-corresponding segment of the video signal $S_V$ related to the upper half field is directly fed to the pixel electrode in the upper half matrix 51*a* which corresponds to the scanning electrode $X_1$ and the signal electrode $Y_2$. A digital version of a subsequent 1-pixel-corresponding segment of the video signal $S_V$ related to the lower half field is read out from an address $M_{1,2}$ of the buffer register and is converted into an analog version, and the analog version of the 1-pixel-corresponding segment of the video signal $S_V$ is fed to the pixel electrode in the lower half matrix 51*b* which corresponds to the scanning electrode $X_{M+1}$ and the signal electrode $Y_2$. The 1-pixel-corresponding segment of the video signal $S_V$ same as that fed to the pixel electrode corresponding to the scanning electrode $X_1$ and the signal electrode $Y_2$ is written into the address $M_{1,2}$ of the buffer register to implement an updating process.

During a third period and later periods, similar processes are iteratively executed while the pixel electrodes in the upper half matrix 51*a* and also the pixel electrodes in the lower half matrix 51*b* are sequentially scanned. Finally, the accessed pixel electrode in the upper half matrix 51*a* becomes the pixel electrode corresponding to the scanning electrode $X_M$ and the signal electrode $Y_N$. Finally, the accessed pixel electrode in the lower half matrix 51*b* becomes the pixel electrode corresponding to the scanning electrode $X_N$ and the signal electrode $Y_N$.

In this way, the video signal $S_V$ representing an upper half field is directly fed to the upper half matrix 51*a* and is written into the buffer register pixel-segment by pixel-segment while the video signal $S_V$ representing a lower half field is fed to the lower half matrix 51*b* from the buffer register. At a final stage, in the buffer memory, the video signal $S_V$ representing the lower half field is completely replaced by the video signal $S_V$ representing the upper half field.

Then, the latter half of the 1-field interval starts. Conditions which occur during the latter half of the 1-field interval will be explained hereinafter. During a first period, a 1-pixel-corresponding segment of the video signal $S_V$ related to a lower half field is directly fed to the pixel electrode in the lower half matrix 51*b* which corresponds to the scanning electrode $X_{M+1}$ and the signal electrode $Y_1$. A digital version of a 1-pixel-corresponding segment of the video signal $S_V$ related to an upper half field is read out from the address $M_{1,1}$ of the buffer register and is converted into an analog version, and the analog version of the 1-pixel-corresponding segment of the video signal $S_V$ is fed to the pixel electrode in the upper half matrix 51*a* which corresponds to the scanning electrode $X_1$ and the signal electrode $Y_1$. The 1-pixel-corresponding segment of the video signal $S_V$, the same as that fed to the pixel electrode corresponding to the scanning electrode $X_{M+1}$ and the signal electrode $Y_1$, is written into the address $M_{1,1}$ of the buffer register to implement an updating process.

During a second period, a subsequent 1-pixel-corresponding segment of the video signal $S_V$ related to the lower half field is directly fed to the pixel electrode in the lower half matrix 51*b* which corresponds to the scanning electrode $X_{M+1}$ and the signal electrode $Y_2$. A digital version of a subsequent 1-pixel-corresponding segment of the video signal $S_V$ related to the upper half field is read out from an address $M_{1,2}$ of the buffer register and is converted into an analog version, and the analog version of the 1-pixel-corresponding segment of the video signal $S_V$ is fed to the pixel electrode in the upper half matrix 51*a* which corresponds to the scanning electrode $X_1$ and the signal electrode $Y_2$. The 1-pixel-corresponding segment of the video signal $S_V$, the same as that fed to the pixel electrode corresponding to the scanning electrode $X_{M+1}$ and the signal electrode $Y_2$, is written into the address $M_{1,2}$ of the buffer register to implement an updating process.

During a third period and later periods, similar processes are iteratively executed while the pixel electrodes in the lower half matrix 51*b* and also the pixel electrodes in the upper half matrix 51*a* are sequentially scanned. Finally, the accessed pixel electrode in the lower half matrix 51*b* becomes the pixel electrode corresponding to the scanning electrode $X_N$ and the signal electrode $Y_N$. Finally, the accessed pixel electrode in the upper half matrix 51*a* becomes the pixel electrode corresponding to the scanning electrode $X_M$ and the signal electrode $Y_N$.

In this way, the video signal $S_V$ representing a lower half field is directly fed to the lower half matrix 51*b* and is written into the buffer register pixel-segment by pixel-segment while the video signal $S_V$ representing an upper half field is fed to the upper half matrix 51*a* from the buffer register. At a final stage, in the buffer memory, the video signal $S_V$ representing the upper half field is completely replaced by the video signal $S_V$ representing the lower half field.

In the prior-art apparatus 50 of FIG. 1, the polarity of the video signal $S_V$ fed to the signal electrodes $Y_1, Y_2, \ldots, Y_N$ via the signal-electrode drive circuit 52 is inverted in every field (see FIG. 2). Accordingly, the polarity of the video signal $S_V$ during each odd-numbered field is opposite to that during each even-numbered field. Thus, the matrix of the liquid-crystal portions 56 is driven by an ac voltage having a frequency equal to half the field frequency of the video signal $S_V$. In the case where the field frequency is 60 Hz, the matrix of the liquid-crystal portions 56 is driven at a frequency of 30 Hz. In this case, the brightness of an indicated picture changes every field so that the indicated picture tends to flicker.

First Embodiment

Figure 3:
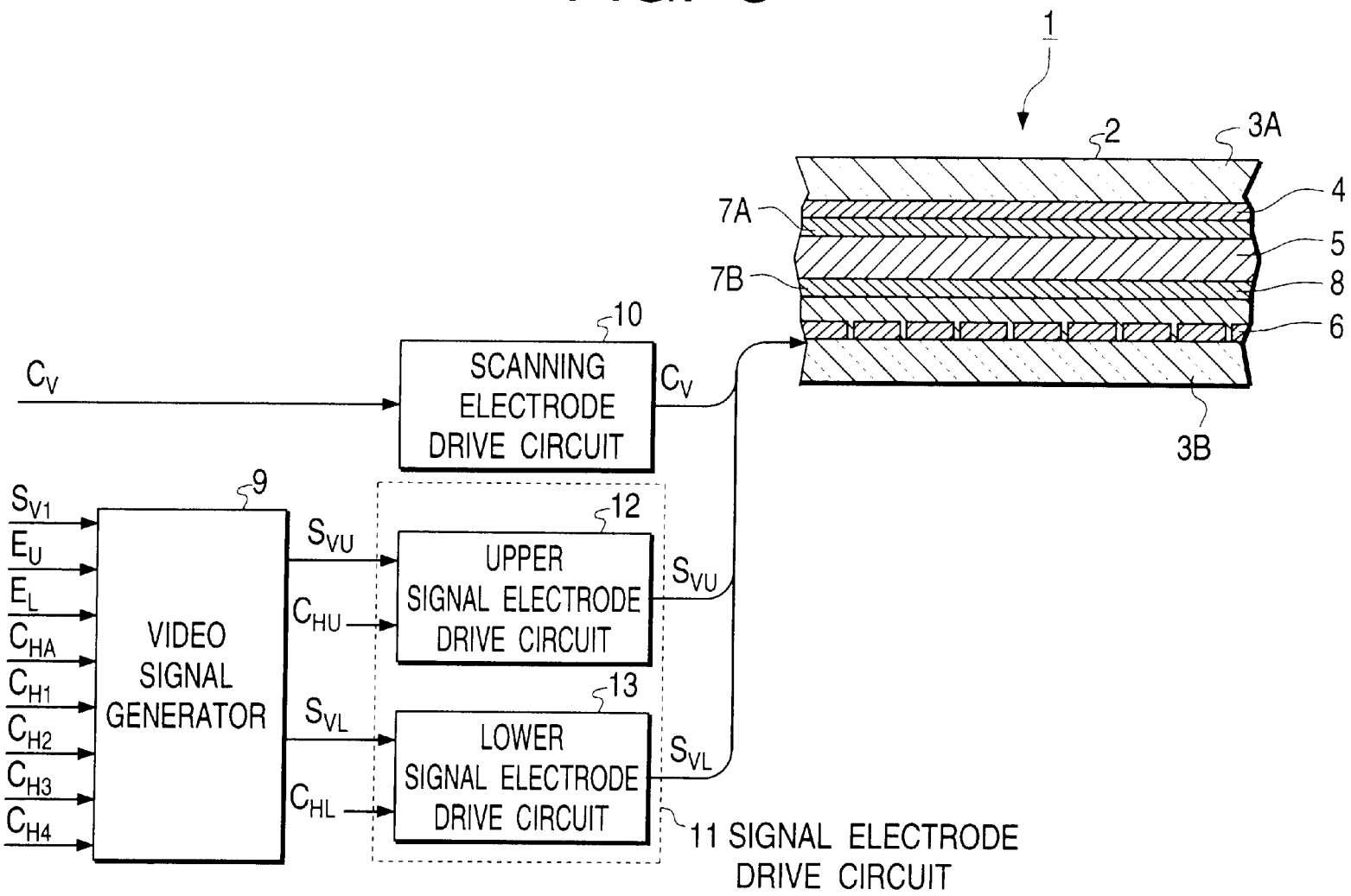
FIG. 3 is a diagram of a liquid-crystal display apparatus according to a first embodiment of this invention.

With reference to FIG. 3, a liquid-crystal display apparatus 1 includes a liquid-crystal display panel 2, a video signal generator 9, a scanning-electrode drive circuit 10, and a signal-electrode drive circuit 11. The signal-electrode drive circuit 11 has an upper signal-electrode drive circuit 12 and a lower signal-electrode drive circuit 13.

The liquid-crystal display panel 2 is of a laminate structure. The liquid-crystal display panel 2 includes a pair of upper and lower glass substrates 3A and 3B extending parallel to each other. In the liquid-crystal display panel 2, a transparent electrode 4 having a layer shape extends on an inner surface (a lower surface) of the upper glass substrate 3A. A pair of upper and lower orientation films 7A and 7B extending parallel to each other is located between the transparent electrode 4 and the lower glass substrate 3B. Liquid crystal 5 is fluid-tightly held between the orientation films 7A and 7B. The liquid-crystal display panel 2 includes a matrix array of pixel electrodes 6 extending on an inner surface (an upper surface) of the lower glass substrate 3B. A dielectric mirror 8 having a layer shape is located between the lower orientation film 7B and the matrix array of the pixel electrodes 6.

A plurality of scanning electrodes and a plurality of signal electrodes are formed by a conductive matrix pattern on the inner surface (the upper surface) of the lower glass substrate 3B. It should be noted that the scanning electrodes and the signal electrodes may be formed on a silicon substrate extending on the inner surface of the lower glass substrate 3B. The scanning electrodes extend along an X direction (a matrix row direction or a horizontal direction with respect to a frame). The signal electrodes extend along a Y direction (a matrix column direction or a vertical direction with respect to the frame). Segments of the matrix pattern where the scanning electrodes and the signal electrodes intersect with each other have switching transistors, respectively. Each of the switching transistors is, for example, a MOS transistor formed on the silicon substrate. Each of the switching transistor may be of a TFT type formed on the lower glass substrate 3B.

A scanning electrode, a signal electrode, and a pixel electrode 6 are connected to three terminals of a switching transistor (the gate, the source, and the drain in the case of an FET), respectively. The switching transistor is changed between an ON state (a conductive state) and an OFF state (a non-conductive state) in response to a drive signal fed via the scanning electrode. When the switching transistor is in its ON state, a video signal $S_{VU}$ or $S_{VL}$ is fed to the related pixel electrode 6 from the related signal electrode via the switching transistor.

A timing pulse generator (not shown) which includes an oscillator and frequency dividers outputs a scanning-electrode control signal $C_V$ to the scanning-electrode drive circuit 10. The scanning-electrode drive circuit 10 includes a shift register. The scanning-electrode drive circuit 10 sequentially activates the scanning electrodes to control the switching transistors in response to the scanning-electrode control signal $C_V$. Time intervals during which the respective scanning electrodes remain activated are equal in length to each other.

As previously described, the signal-electrode drive circuit 11 has the upper signal-electrode drive circuit 12 and the lower signal-electrode drive circuit 13. The upper signal-electrode drive circuit 12 is designed to drive signal electrodes in the upper half of the liquid-crystal display panel 2. On the other hand, the lower signal-electrode drive circuit 13 is designed to drive signal electrodes in the lower half of the liquid-crystal display panel 2.

The upper signal-electrode drive circuit 12 includes a shift register. The upper signal-electrode drive circuit 12 receives an upper signal-electrode control signal $C_{HU}$ from the timing pulse generator. The upper signal-electrode drive circuit 12 transmits a video signal $S_{VU}$ from the video signal generator 9 to the related signal electrodes in response to the upper signal-electrode control signal $C_{HU}$. The video signal $S_{VU}$ is indicated by the upper half of the liquid-crystal display panel 2.

The lower signal-electrode drive circuit 13 includes a shift register. The lower signal-electrode drive circuit 13 receives a lower signal-electrode control signal $C_{HL}$ from the timing pulse generator. The lower signal-electrode drive circuit 13 transmits a video signal $S_{VL}$ from the video signal generator 9 to the related signal electrodes in response to the lower signal-electrode control signal $C_{HL}$. The video signal $S_{VL}$ is indicated by the lower half of the liquid-crystal display panel 2.

The video signal generator 9 includes memories, switches, and polarity inverters. The video signal generator 9 receives read/write control signals $E_U$ and $E_L$ from the timing pulse generator. The video signal generator 9 stores and reads a source video signal (an input video signal) $S_{VI}$ into and from the internal memories in response to the read/write control signals $E_U$ and $E_L$. The input video signal $S_{VI}$ sequentially represents fields. The video signal generator 9 receives a memory change signal $C_{HA}$ from the timing pulse generator. The video signal generator 9 periodically selects one of the internal memories in response to the memory change signal $C_{HA}$. The input video signal $S_{VI}$ is made into a delayed video signal $S_{VM}$ by the memories. The video signal generator 9 receives change control signals $C_{H1}$, $C_{H2}$, $C_{H3}$, and $C_{H4}$ from the timing pulse generator. The video signal generator 9 changes the input video signal $S_{VI}$ and the delayed video signal $S_{VM}$ in response to the change control signals $C_{H1}$, $C_{H2}$, $C_{H3}$, and $C_{H4}$, thereby converting the input video signal $S_{VI}$ and the delayed video signal $S_{VM}$ into the video signals $S_{VU}$ and $S_{VL}$. The video signal generator 9 feeds the video signals $S_{VU}$ and $S_{VL}$ to the upper signal-electrode drive circuit 12 and the lower signal-electrode drive circuit 13, respectively.

Figure 4:
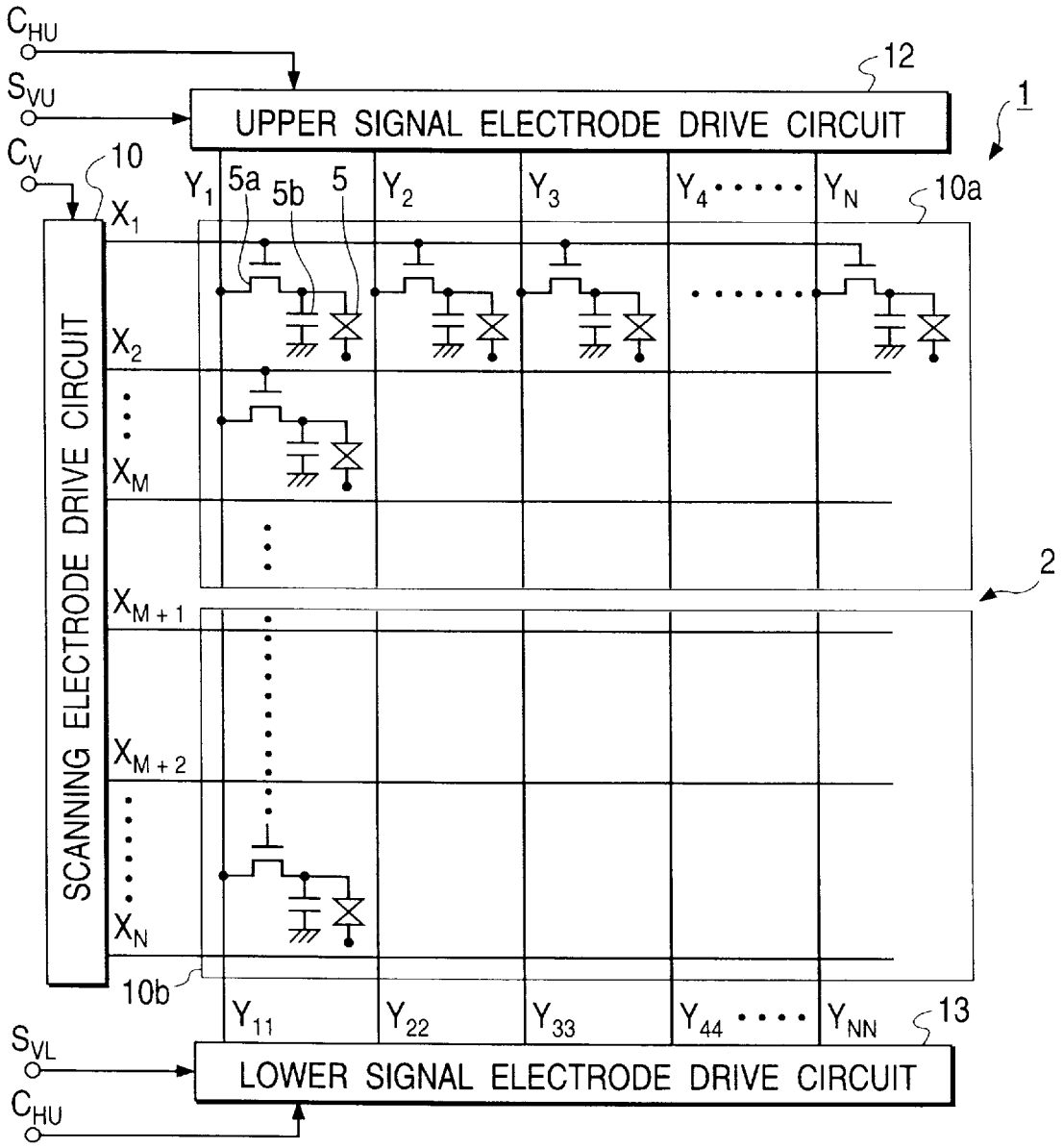
FIG. 4 is another diagram of the liquid-crystal display apparatus according to the first embodiment of this invention.

As shown in FIG. 4, the liquid-crystal display apparatus 1 includes a plurality of scanning electrodes $X_1, X_2, \ldots, X_N$, a plurality of upper signal electrodes $Y_1, Y_2, \ldots, Y_N$, and a plurality of lower signal electrodes $Y_{11}, Y_{22}, \ldots, Y_{NN}$. Here, "N" denotes a given natural number. The scanning electrodes $X_1, X_2, \ldots, X_N$ extend along matrix rows. The upper signal electrodes $Y_1, Y_2, \ldots, Y_N$ extend along matrix columns. Also, the lower signal electrodes $Y_{11}, Y_{22}, \ldots, Y_{NN}$ extend along matrix columns.

Segments of a matrix where the scanning electrodes $X_1, X_2, \ldots, X_N$, the upper signal electrodes $Y_1, Y_2, \ldots, Y_N$, and the lower signal electrodes $Y_{11}, Y_{22}, \ldots, Y_{NN}$ intersect with each other have switching transistors 5*a*, respectively. One end of the switching transistors 5*a* is connected to pixel electrodes 6 (see FIG. 3) respectively. One end of the switching transistors 5*a* is also connected to capacitors 5*b* respectively. Each capacitor 5*b* serves to store a 1-pixel-corresponding segment of a video signal $S_{VU}$ or $S_{VL}$. In addition, each capacitor 5*b* continuously subjects a 1-pixel-corresponding portion of the liquid crystal 5 to a signal voltage (an electric field) depending on the 1-pixel-corresponding segment of the video signal $S_{VU}$ or $S_{VL}$. The application of the signal voltage (the electric field) to the 1-pixel-corresponding portion of the liquid crystal 5 is implemented via the pixel electrode 6 (see FIG. 3).

The liquid-crystal display panel 2 is divided into upper and lower halves 10*a* and 10*b* corresponding to upper and lower halves of a field respectively. The scanning electrodes $X_1, X_2, \ldots, X_N$ are separated into two groups, that is, a group having the upper-half scanning electrodes $X_1, X_2, \ldots, X_M$ and a group having the lower-half scanning electrodes $X_{M+1}, X_{M+2}, \ldots, X_N$. Here, "M" denotes a given natural number equal to, for example, a half of the number "N". The upper half 10*a* of the liquid-crystal display panel 2 contains the group of the upper-half scanning electrodes $X_1, X_2, \ldots, X_M$. The lower half 10*b* of the liquid-crystal display panel 2 contains the group of the lower-half scanning electrodes $X_{M+1}, X_{M+2}, \ldots, X_N$. The upper half 10*a* of the liquid-crystal display panel 2 contains the upper signal electrodes $Y_1, Y_2, \ldots, Y_N$. The lower half 10*b* of the liquid-crystal display panel 2 contains the lower signal electrodes $Y_{11}, Y_{22}, \ldots, Y_{NN}$.

The scanning-electrode drive circuit 10 is connected to the scanning electrodes $X_1, X_2, \ldots, X_N$. The upper signal-electrode drive circuit 12 is connected to the upper signal electrodes $Y_1, Y_2, \ldots, Y_N$ which intersect with the upper-half scanning electrodes $X_1, X_2, \ldots, X_M$. The lower signal-electrode drive circuit 13 is connected to the lower signal electrodes $Y_{11}, Y_{22}, \ldots, Y_{NN}$ which intersect with the lower-half scanning electrodes $X_{M+1}, X_{M+2}, \ldots, X_N$.

The scanning-electrode drive circuit 10 feeds drive signals to the scanning electrodes $X_1, X_2, \ldots, X_N$ at different timings in response to a scanning-electrode control signal $C_V$, respectively. The upper signal-electrode drive circuit 12 feeds time segments of the video signal $S_{VU}$ to the upper signal electrodes $Y_1, Y_2, \ldots, Y_N$ in response to an upper signal-electrode control signal $C_{HU}$, respectively. The lower signal-electrode drive circuit 13 feeds time segments of the video signal $S_{VL}$ to the lower signal electrodes $Y_{11}, Y_{22}, \ldots, Y_{NN}$ in response to a lower signal-electrode control signal $C_{HL}$, respectively.

Summary of operation of the liquid-crystal display apparatus 1 of FIGS. 3 and 4 is as follows. During the former half of a 1-field interval, an input video signal representing the upper half of a present field is directly fed to the upper half 10*a* of the liquid-crystal display panel 2 while a video signal representing the lower half of a previous field is fed from a memory to the lower half 10*b* of the liquid-crystal display panel 2. During the latter half of the 1-field interval, an input video signal representing the lower half of the present field is directly fed to the lower half 10*b* of the liquid-crystal display panel 2 while a video signal representing the upper half of the present field is fed from the memory to the upper half 10*a* of the liquid-crystal display panel 2. These processes are reiterated. The memory stores the input video signal half-field by half-field. The polarity of the video signal $S_{VU}$ fed to the upper half 10*a* of the liquid-crystal display panel 2 is inverted in every half field. Also, the polarity of the video signal $S_{VL}$ fed to the lower half 10*b* of the liquid-crystal display panel 2 is inverted in every half field.

When the total number of the scanning electrodes $X_1, X_2, \ldots, X_N$ is even, it is preferable to equalize the number of scanning electrodes contained in the upper half 10*a* of the liquid-crystal display panel 2 and the number of scanning electrodes contained in the lower half 10*b* thereof. When the total number of the scanning electrodes $X_1, X_2, \ldots, X_N$ is odd, it is preferable that the number of scanning electrodes contained in the upper half 10*a* of the liquid-crystal display panel 2 differs from the number of scanning electrodes contained in the lower half 10*b* thereof by one.

Figure 5:
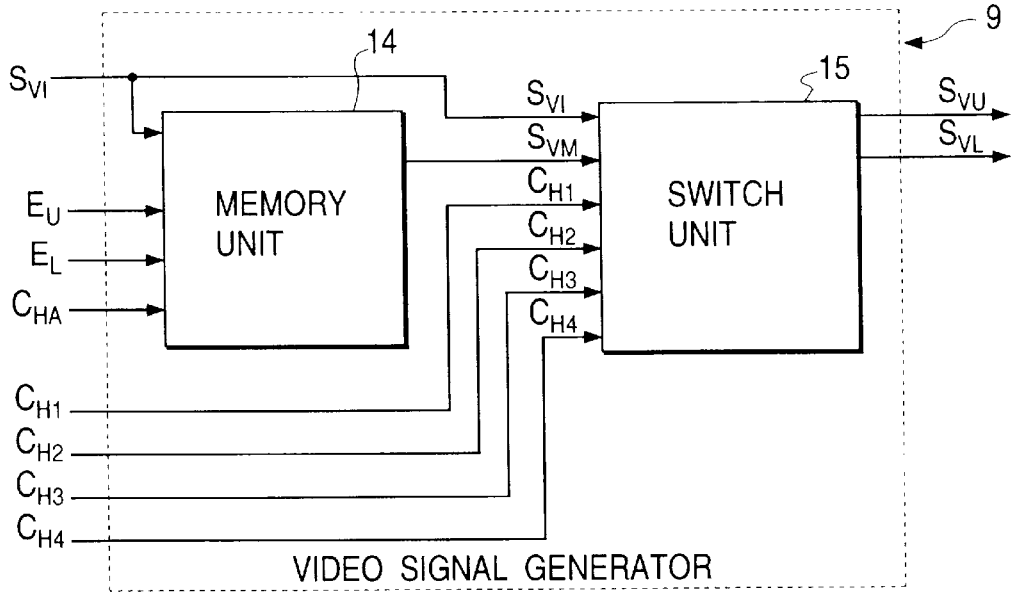
FIG. 5 is a block diagram of a video signal generator in FIG. 3.

As shown in FIG. 5, the video signal generator 9 includes a memory unit 14 and a switch unit 15. The input side of the switch unit 15 is connected to the output side of the memory unit 14. The output side of the switch unit 15 is connected to the signal-electrode drive circuit 11 (see FIG. 3).

An input video signal (a source video signal) $S_{VI}$ is applied to the memory unit 14 and the switch unit 15. The memory unit 14 receives the read/write control signals $E_U$ and $E_L$ from the timing pulse generator. The input video signal $S_{VI}$ is temporarily stored in the memory unit 14 in response to the read/write control signals $E_U$ and $E_L$ before being outputted from the memory unit 14 to the switch unit 15 as a delayed video signal $S_{VM}$. The memory unit 14 has two memories assigned to the upper and lower halves of every field respectively. The input video signal $S_{VI}$ which represents the upper half of a field is stored in the upper field memory in response to the read/write control signal $E_U$. On the other hand, the input video signal $S_{VI}$ which represents the lower half of a field is stored in the lower field memory in response to the read/write control signal $E_L$. The memory unit 14 receives the memory change signal $C_{HA}$ from the timing pulse generator. The memory unit 14 includes a selector. One of the memories is periodically and selectively connected to the switch unit 15 via the selector in response to the memory change signal $C_{HA}$ so that a suitable delayed video signal $S_{VM}$ will be fed from the memory unit 14 to the switch unit 15.

The switch unit 15 receives the change control signals $C_{H1}$, $C_{H2}$, $C_{H3}$, and $C_{H4}$ from the timing pulse generator. The switch unit 15 periodically executes a change between the input video signal $S_{VI}$ and the delayed video signal $S_{VM}$ in response to the change control signals $C_{H1}$ and $C_{H2}$. The switch unit 15 periodically inverts the polarities of the change-resultant video signals in response to the change control signals $C_{H3}$ and $C_{H4}$, thereby generating the video signals $S_{VU}$ and $S_{VL}$. The switch unit outputs the video signals $S_{VU}$ and $S_{VL}$ to the upper signal-electrode drive circuit 12 and the lower signal-electrode drive circuit 13 (see FIG. 3) respectively.

Figure 6:
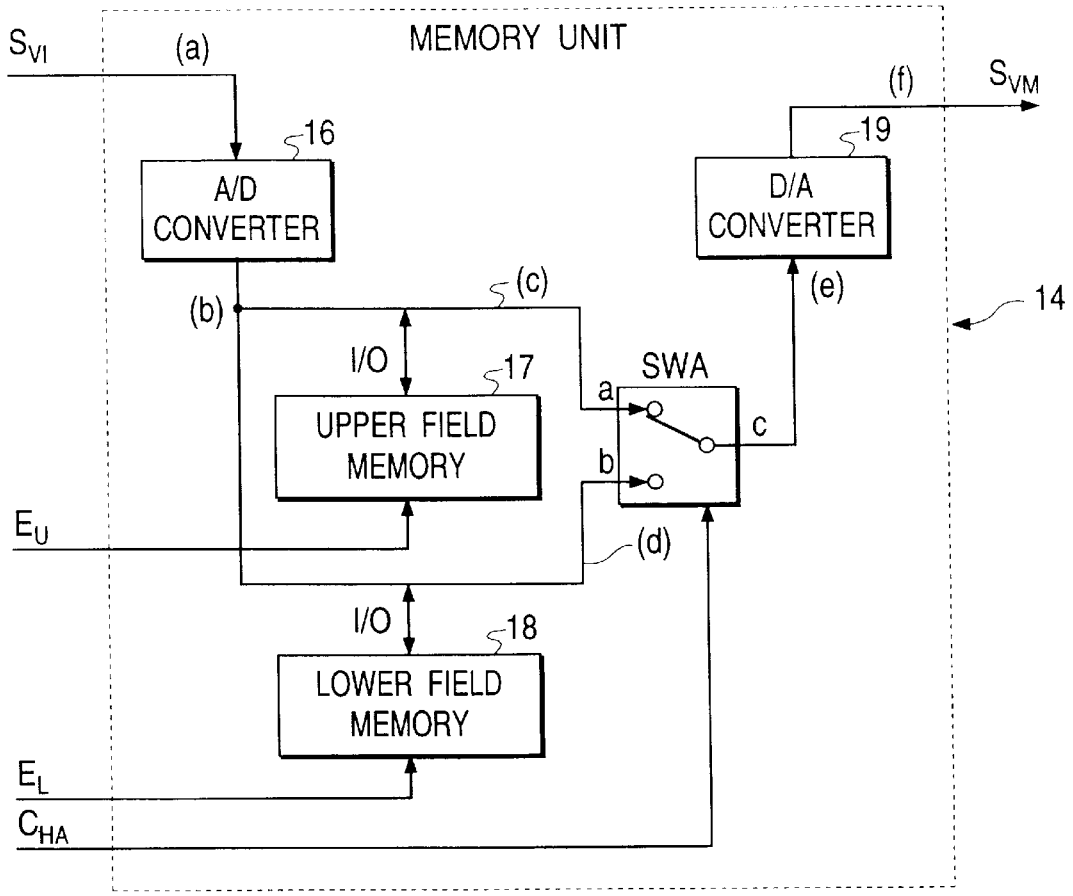
FIG. 6 is a block diagram of a memory unit in FIG. 5.

As shown in FIG. 6, the memory unit 14 includes an A/D (analog-to-digital) converter 16, a memory 17 for the upper half of a field, a memory 18 for the lower half of a field, a D/A (digital-to-analog) converter 19, and a selector or switch SWA.

The input terminal of the A/D converter 16 receives the input video signal $S_{VI}$. The output terminal of the A/D converter 16 is connected to the upper field memory 17 and the lower field memory 18. The upper field memory 17 receives the read/write control signal $E_U$. The lower field memory 18 receives the read/write control signal $E_L$. The upper field memory 17 is connected to a first fixed contact "a" of the selector SWA. The lower field memory 18 is connected to a second fixed contact "b" of the selector SWA. The selector SWA has a movable contact "c" which selectively touches one of the fixed contacts "a" and "b". The selector SWA has a control terminal subjected to the memory change signal $C_{HA}$. The movable contact "c" of the selector SWA leads to the input terminal of the D/A converter 19. The output terminal of the D/A converter 19 is connected to the switch unit 15 (see FIG. 5).

The A/D converter 16 changes the input video signal $S_{VI}$ into a corresponding digital video signal. The A/D converter 16 outputs the digital video signal to the upper field memory 17 and the lower field memory 18. The digital video signal representing the upper half of a field is written into the upper field memory 17 in response to the read/write control signal $E_U$. The digital video signal representing the lower half of a field is written into the lower field memory 18 in response to the read/write control signal $E_L$. While the digital video signal representing the upper half of a field is written into the upper field memory 17, the digital video signal representing the lower half of a field is read out from the lower field memory 18 in response to the read/write control signal $E_L$. While the digital video signal representing the lower half of a field is written into the lower field memory 18, the digital video signal representing the upper half of a field is read out from the upper field memory 17 in response to the read/write control signal $E_U$. The upper half-fleld video signal read out from the upper field memory 17 is applied to the first fixed contact "a" of the selector SWA. The lower half-field video signal read out from the lower field memory 18 is applied to the second fixed contact "a" of the selector SWA. The device SWA alternately and periodically selects one out of the upper half-field video signal and the lower half-field video signal in response to the memory change signal $C_{HA}$, and transmits the selected video signal to the D/A converter 19 via its movable contact "c". The selected video signal changes between the upper half-field video signal and the lower half-field video signal at moments spaced by half-field intervals. The D/A converter 19 changes the received video signal into a corresponding analog video signal $S_{VM}$. The resultant video signal $S_{VM}$ is delayed from the input video signal $S_{VI}$ by a time interval corresponding to a half of a field. The D/A converter 19 outputs the video signal $S_{VM}$ to the switch unit 15 (see FIG. 5).

Figure 7:
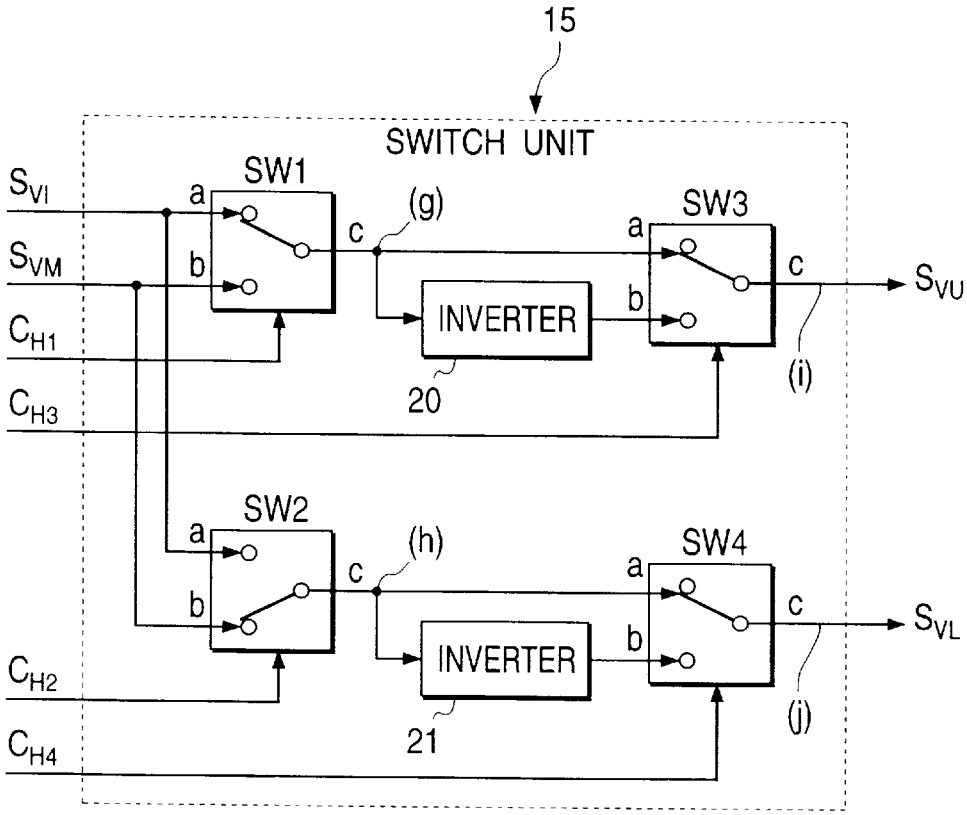
FIG. 7 is a block diagram of a switch unit in FIG. 5.

As shown in FIG. 7, the switch unit 15 includes switches SW1, SW2, SW3, and SW4, and polarity inverters 20 and 21. A first fixed contact "a" of the switch SW1 receives the input video signal $S_{VI}$. A second fixed contact "b" of the switch SW1 receives the video signal $S_{VM}$ from the memory unit 14 (see FIG. 5). The switch SW1 has a movable contact "c" which selectively touches one of the fixed contacts "a" and "b" thereof. The switch SW1 has a control terminal subjected to the change control signal $C_{H1}$. The movable contact "c" of the switch SW1 leads to the input terminal of the inverter 20 and also a first fixed contact "a" of the switch SW3. The output terminal of the inverter 20 is connected to a second fixed contact "b" of the switch SW3. The switch SW3 has a movable contact "c" which selectively touches one of the fixed contacts "a" and "b" thereof. The switch SW3 has a control terminal subjected to the change control signal $C_{H3}$. The movable contact "c" of the switch SW3 is connected to the upper signal-electrode drive circuit 12 (see FIG. 3).

A first fixed contact "a" of the switch SW2 receives the input video signal $S_{VI}$. A second fixed contact "b" of the switch SW2 receives the video signal $S_{VM}$ from the memory unit 14 (see FIG. 5). The switch SW2 has a movable contact "c" which selectively touches one of the fixed contacts "a" and "b" thereof. The switch SW2 has a control terminal subjected to the change control signal $C_{H2}$. The movable contact "c" of the switch SW2 leads to the input terminal of the inverter 21 and also a first fixed contact "a" of the switch SW4. The output terminal of the inverter 21 is connected to a second fixed contact "b" of the switch SW4. The switch SW4 has a movable contact "c" which selectively touches one of the fixed contacts "a" and "b" thereof. The switch SW4 has a control terminal subjected to the change control signal $C_{H4}$. The movable contact "c" of the switch SW4 is connected to the lower signal-electrode drive circuit 13 (see FIG. 3).

The switch SW1 selects one out of the video signals $S_{VI}$ and $S_{VM}$ in response to the change control signal $C_{H1}$, and outputs the selected video signal to the inverter 20 and the switch SW3. The device 20 inverts the polarity of the output signal of the switch SW1. The output signal of the inverter 20 is fed to the switch SW3. The switch SW3 selects one out of the output signal of the switch SW1 and the output signal of the inverter 20 in response to the change control signal $C_{H3}$, and outputs the selected signal as the video signal $S_{VU}$. The switch SW2 selects one out of the video signals $S_{VI}$ and $S_{VM}$ in response to the change control signal $C_{H2}$, and outputs the selected video signal to the inverter 21 and the switch SW4. The device 21 inverts the polarity of the output signal of the switch SW2. The output signal of the inverter 21 is fed to the switch SW4. The switch SW4 selects one out of the output signals of the switch SW2 and the output signal of the inverter 21 in response to the change control signal $C_{H4}$, and outputs the selected signal as the video signal $S_{VL}$.

During the former half of every 1-field interval, the switch SW1 selects the video signal $S_{VI}$ in response to the change control signal $C_{H1}$, and outputs the selected video signal $S_{VI}$ to the inverter 20 and the switch SW3. The switch SW3 selects the output signal of the switch SW1, that is, the video signal $S_{VI}$. The switch SW3 outputs the selected video signal $S_{VI}$ as a positive-polarity video signal $S_{VU}$. During the former half of every 1-field interval, the switch SW2 selects the video signal $S_{VM}$ in response to the change control signal $C_{H2}$, and outputs the selected video signal $S_{VM}$ to the inverter 21 and the switch SW4. The switch SW4 selects the output signal of the switch SW2, that is, the video signal $S_{VM}$. The switch SW4 outputs the selected video signal $S_{VM}$ as a positive-polarity video signal $S_{VL}$.

During the latter half of every 1-field interval, the switch SW1 selects the video signal $S_{VM}$ in response to the change control signal $C_{H1}$, and outputs the selected video signal $S_{VM}$ to the inverter 20 and the switch SW3. The device 20 inverts the polarity of the video signal $S_{VM}$. The inverter 20 outputs the polarity inversion of the video signal $S_{VM}$ to the switch SW3. The switch SW3 selects the output signal of the inverter 20, that is, the polarity inversion of the video signal $S_{VM}$. The switch SW3 outputs the polarity inversion of the video signal $S_{VM}$ as a negative-polarity video signal $S_{VU}$. During the latter half of every 1-field interval, the switch SW2 selects the video signal $S_{VI}$ in response to the change control signal $C_{H2}$, and outputs the selected video signal $S_{VI}$ to the inverter 21 and the switch SW4. The device 21 inverts the polarity of the video signal $S_{VI}$. The inverter 21 outputs the polarity inversion of the video signal $S_{VI}$ to the switch SW4. The switch SW4 selects the output signal of the inverter 21, that is, the polarity inversion of the video signal $S_{VI}$. The switch SW4 outputs the polarity inversion of the video signal $S_{VI}$ as a negative-polarity video signal $S_{VL}$.

In this way, the polarity of the video signal $S_{VU}$ outputted from the switch unit 15 is inverted every half field. Also, the polarity of the video signal $S_{VL}$ outputted from the switch unit 15 is inverted every half field. In other words, the video signals $S_{VU}$ and $S_{VL}$ change between the positive polarity and the negative polarity at a frequency corresponding to the field frequency of the input video signal $S_{VI}$. In the case where the field frequency is 60 Hz, the polarity change of the video signals $S_{VU}$ and $S_{VL}$ has a frequency of 60 Hz.

Figure 8:
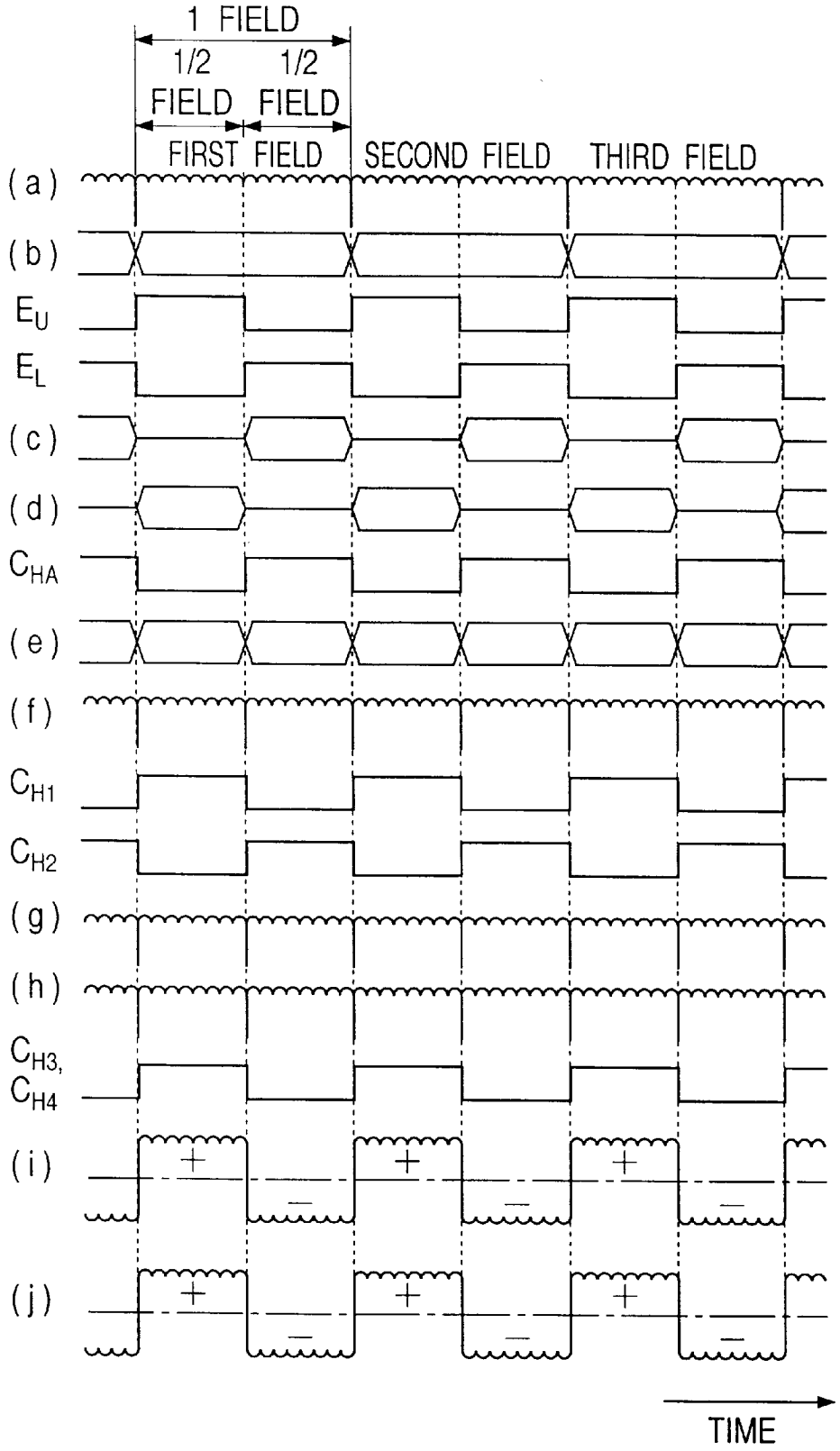
FIG. 8 is a time-domain diagram of various signals in the apparatus of FIGS. 3 and 4.

The input side (a) of the A/D converter 16 (see FIG. 6) is subjected to the input video signal $S_{VI}$ which has a waveform such as shown by the portion (a) of FIG. 8. The input video signal $S_{VI}$ has a sequence of 1-field corresponding segments. The output side (b) of the A/D converter 16 is subjected to the digital version of the input video signal $S_{VI}$ which has a sequence of 1-field corresponding segments as shown in the portion (b) of FIG. 8. The read/write control signal $E_U$ fed to the upper field memory 17 (see FIG. 6) periodically changes between a high level and a low level as shown in the portion $E_U$ of FIG. 8. During the former half of every 1-field interval, the read/write control signal $E_U$ is in the high-level state so that the digital version of the input video signal $S_{VI}$ is written into the upper field memory 17 while the reading of the digital video signal from the upper field memory 17 remains inhibited. During the latter half of every 1-field interval, the read/write control signal $E_U$ is in the low-level state so that the writing of the digital version of the input video signal $S_{VI}$ into the upper field memory 17 remains inhibited while the digital video signal is read out from the upper field memory 17. The read/write control signal $E_L$ fed to the lower field memory 18 (see FIG. 6) periodically changes between a high level and a low level as shown in the portion $E_L$ of FIG. 8. During the former half of every 1-field interval, the read/write control signal $E_L$ is in the low-level state so that the writing of the digital version of the input video signal $S_{VI}$ into the lower field memory 18 remains inhibited while the digital video signal is read out from the lower field memory 18. During the latter half of every 1-field interval, the read/write control signal $E_L$ is in the high-level state so that the digital version of the input video signal $S_{VI}$ is written into the lower field memory 18 while the reading of the digital video signal from the lower field memory 18 remains inhibited.

The connection (c) between the upper field memory 17 and the selector SWA is subjected to the output video signal (the upper half-field video signal) from the upper field memory 17 which is effective during the latter half of every 1-field interval as shown by the portion (c) of FIG. 8. The connection (d) between the lower field memory 18 and the selector SWA is subjected to the output video signal (the lower half-field video signal) from the lower field memory 18 which is effective during the former half of every 1-field interval as shown by the portion (d) of FIG. 8. The memory change signal $C_{HA}$ fed to the selector SWA (see FIG. 6) periodically changes between a high level and a lower level as shown in the portion $C_{HA}$ of FIG. 8. During the former half of every 1-field interval, the memory change signal $C_{HA}$ is in the low-level state so that the switch SWA selects the output video signal (the the lower half-field video signal) from the lower field memory 18. During the latter half of every 1-field interval, the memory change signal $C_{HA}$ is in the high-level state so that the device SWA selects the output video signal (the upper half-field video signal) from the upper field memory 17. The connection (e) between the selector SWA and the D/A converter 19 (see FIG. 6) is subjected to the output video signal from the selector SWA which agrees with a combination of the output video signals from the upper and lower field memories 17 and 18 as shown in the portion (e) of FIG. 8. The output side (f) of the D/A converter 19 is subjected to the analog version of the output video signal from the selector SWA as shown in the potion (f) of FIG. 8. The analog version of the output video signal from the selector SWA is the video signal $S_{VM}$ which is delayed from the input video signal $S_{VI}$ by a time interval corresponding to a half of a field.

The change control signal $C_{H1}$ fed to the switch SW1 (see FIG. 7) periodically changes between a high level and a low level as shown in the portion $C_{H1}$ of FIG. 8. During the former half of every 1-field interval, the change control signal $C_{H1}$ is in the high-level state so that the switch SW1 selects the video signal $S_{VI}$. During the latter half of every 1-field interval, the change control signal $C_{H1}$ is in the low-level state so that the switch SW1 selects the video signal $S_{VM}$. The change control signal $C_{H2}$ fed to the switch SW2 (see FIG. 7) periodically changes between a high level and a low level as shown in the portion $C_{H2}$ of FIG. 8. During the former half of every 1-field interval, the change control signal $C_{H2}$ is in the low-level state so that the switch SW2 selects the video signal $S_{VM}$. During the latter half of every 1-field interval, the change control signal $C_{H2}$ is in the high-level state so that the switch SW2 selects the video signal $S_{VI}$. The output side (g) of the switch SW1 is subjected to the output video signal from the switch SW1 which has a waveform such as shown in the portion (g) of FIG. 8. Specifically, the output video signal from the switch SW1 agrees with the input video signal (the non-delayed video signal) $S_{VI}$ during the former half of every 1-field interval, and agrees with the delayed video signal $S_{VM}$ during the latter half of every 1-field interval. The output side (h) of the switch SW2 is subjected to the output video signal from the switch SW2 which has a waveform such as shown in the portion (h) of FIG. 8. Specifically, the output video signal from the switch SW2 agrees with the delayed video signal $S_{VM}$ during the former half of every 1-field interval, and agrees with the input video signal (the non-delayed video signal) $S_{VI}$ during the latter half of every 1-field interval.

The change control signal $C_{H3}$ fed to the switch SW3 (see FIG. 7) periodically changes between a high level and a low level as shown in the portion $C_{H3}$ of FIG. 8. During the former half of every 1-field interval, the change control signal $C_{H3}$ is in the high-level state so that the switch SW3 selects the output signal of the switch SW1, that is, the positive-polarity non-delayed video signal $S_{VI}$. During the latter half of every 1-field interval, the change control signal $C_{H3}$ is in the low-level state so that the switch SW3 selects the output signal of the inverter 20, that is, the negative-polarity delayed video signal $S_{VM}$. The change control signal $C_{H4}$ fed to the switch SW4 (see FIG. 7) periodically changes between a high level and a low level as shown in the portion $C_{H4}$ of FIG. 8. During the former half of every 1-field interval, the change control signal $C_{H4}$ is in the high-level state so that the switch SW4 selects the output signal of the switch SW2, that is, the positive-polarity delayed video signal $S_{VM}$. During the latter half of every 1-field interval, the change control signal $C_{H4}$ is in the low-level state so that the switch SW4 selects the output signal of the inverter 21, that is, the negative-polarity non-delayed video signal $S_{VI}$. The output side (i) of the switch SW3 is subjected to the output video signal from the switch SW3 which has a waveform such as shown in the portion (i) of FIG. 8. The output video signal from the switch SW3 agrees with the video signal $S_{VU}$. The output video signal from the switch SW3, that is, the video signal $S_{VU}$, has a positive polarity during the former half of every 1-field interval, and has a negative polarity during the latter half of every 1-field interval. The output side (j) of the switch SW4 is subjected to the output video signal from the switch SW4 which has a waveform such as shown in the portion (j) of FIG. 8. The output video signal from the switch SW4 agrees with the video signal $S_{VL}$. The output video signal from the switch SW4, that is, the video signal $S_{VL}$, has a positive polarity during the former half of every 1-field interval, and has a negative polarity during the latter half of every 1-field interval.

In the liquid-crystal display apparatus 1, the video signal generator 9 outputs the video signal $S_{VU}$ to the upper signal-electrode drive circuit 12. The upper signal-electrode drive circuit 12 feeds time segments of the video signal $S_{VU}$ to the upper signal electrodes $Y_1, Y_2, \ldots, Y_N$ in response to the upper signal-electrode control signal $C_{HU}$, respectively. In addition, the video signal generator 9 outputs the video signal $S_{VL}$ to the lower signal-electrode drive circuit 13. The lower signal-electrode drive circuit 13 feeds time segments of the video signal $S_{VL}$ to the lower signal electrodes $Y_{11}, Y_{22}, \ldots, Y_{NN}$ in response to the lower signal-electrode control signal $C_{HL}$, respectively. The polarity of each of the video signals $S_{VU}$ and $S_{VL}$ fed to the signal electrodes $Y_1, Y_2, \ldots, Y_N$ and the signal electrodes $Y_{11}, Y_{22}, \ldots, Y_{NN}$ is inverted every half field. Accordingly, the polarity of each of the video signals $S_{VU}$ and $S_{VL}$ during the former half of every 1-field interval is opposite to that during the latter half of every 1-field interval. Thus, the matrix of the 1-pixel corresponding portions of the liquid crystal 5 is driven by an ac voltage having a frequency equal to the field frequency of the input video signal $S_{VI}$. In the case where the field frequency is 60 Hz, the matrix of the 1-pixel-corresponding portions of the liquid crystal 5 is driven at a frequency of 60 Hz. Accordingly, the frequency of the ac drive voltage for the matrix in the liquid-crystal display apparatus 1 is equal to twice the frequency of the ac drive voltage for the matrix in the prior-art apparatus of FIG. 1. Thus, the liquid-crystal display apparatus 1 is advantageous over the prior-art apparatus of FIG. 1 in suppressing a flicker of an indicated picture.

Second Embodiment

A second embodiment of this invention is similar to the embodiment of FIGS. 3–8 except that a memory unit 22 replaces the memory unit 14 (see FIGS. 5 and 6).

Figure 9:
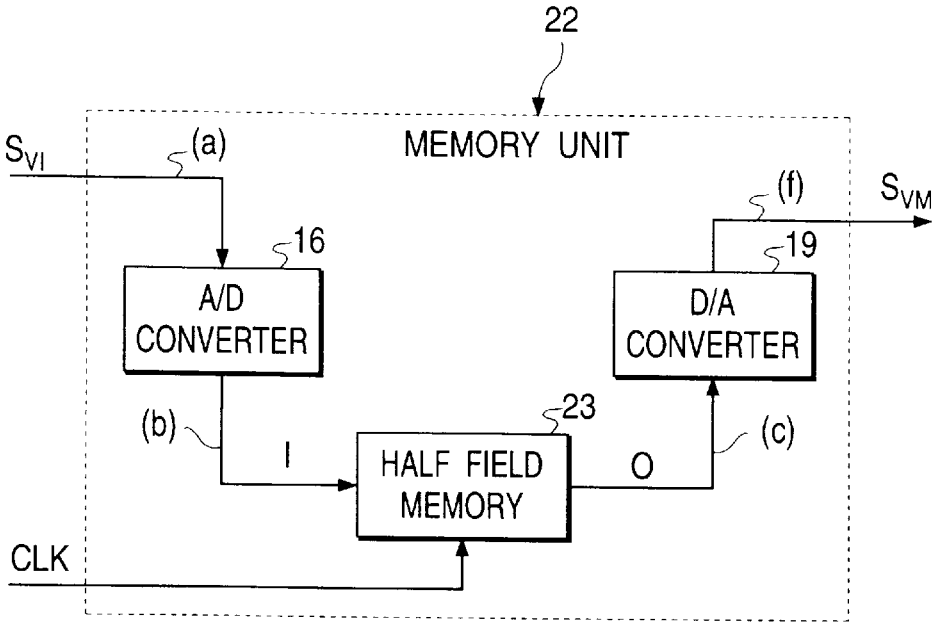
FIG. 9 is a block diagram of a memory unit in a liquid-crystal display apparatus according to a second embodiment of this invention.

As shown in FIG. 9, the memory unit 22 includes an A/D (analog-to-digital) converter 16, a memory 23, and a D/A (digital-to-analog) converter 19. The input terminal of the A/D converter 16 receives an input video signal $S_{VI}$. The output terminal of the A/D converter 16 is connected to the input side of the memory 23. The memory 23 has a capacity corresponding to a half of a field represented by the input video signal $S_{VI}$. The memory 23 receives a data control signal CLK having a given high frequency. The output side of the memory 23 is connected to the input terminal of the D/A converter 19. The output terminal of the D/A converter 19 is connected to a switch unit 15 (see FIG. 5).

The A/D converter 16 changes the input video signal $S_{VI}$ into a corresponding digital video signal. The A/D converter 16 outputs the digital video signal to the memory 23. Samples of the digital video signal are written into and read out from the memory 23 on a time division basis in response to the data control signal CLK. Thereby, the memory 23 serves to delay the digital video signal by a time interval corresponding to a half of a field. The digital video signal read out from the memory 23 is fed to the D/A converter 19. The D/A converter 19 changes the received digital video signal into a corresponding analog video signal $S_{VM}$. The resultant video signal $S_{VM}$ is delayed from the input video signal $S_{VI}$ by a time interval corresponding to a half of a field. The D/A converter 19 outputs the video signal $S_{VM}$ to the switch unit 15 (see FIG. 5).

Third Embodiment

A third embodiment of this invention is similar to the embodiment of FIGS. 3–8 or the embodiment of FIG. 9 except that a delay device shifts the phase of a change control signal $C_{H4}$ from the phase of a change control signal $C_{H3}$ by a quantity corresponding to a half of a field. In the third embodiment, the phase of a video signal $S_{VL}$ shifts from the phase of a video signal $S_{VU}$ by a quantity corresponding to a half of a field. Accordingly, the polarities of the video signals $S_{VL}$ and $S_{VU}$ are always opposite to each other.

Fourth Embodiment

Figure 10:
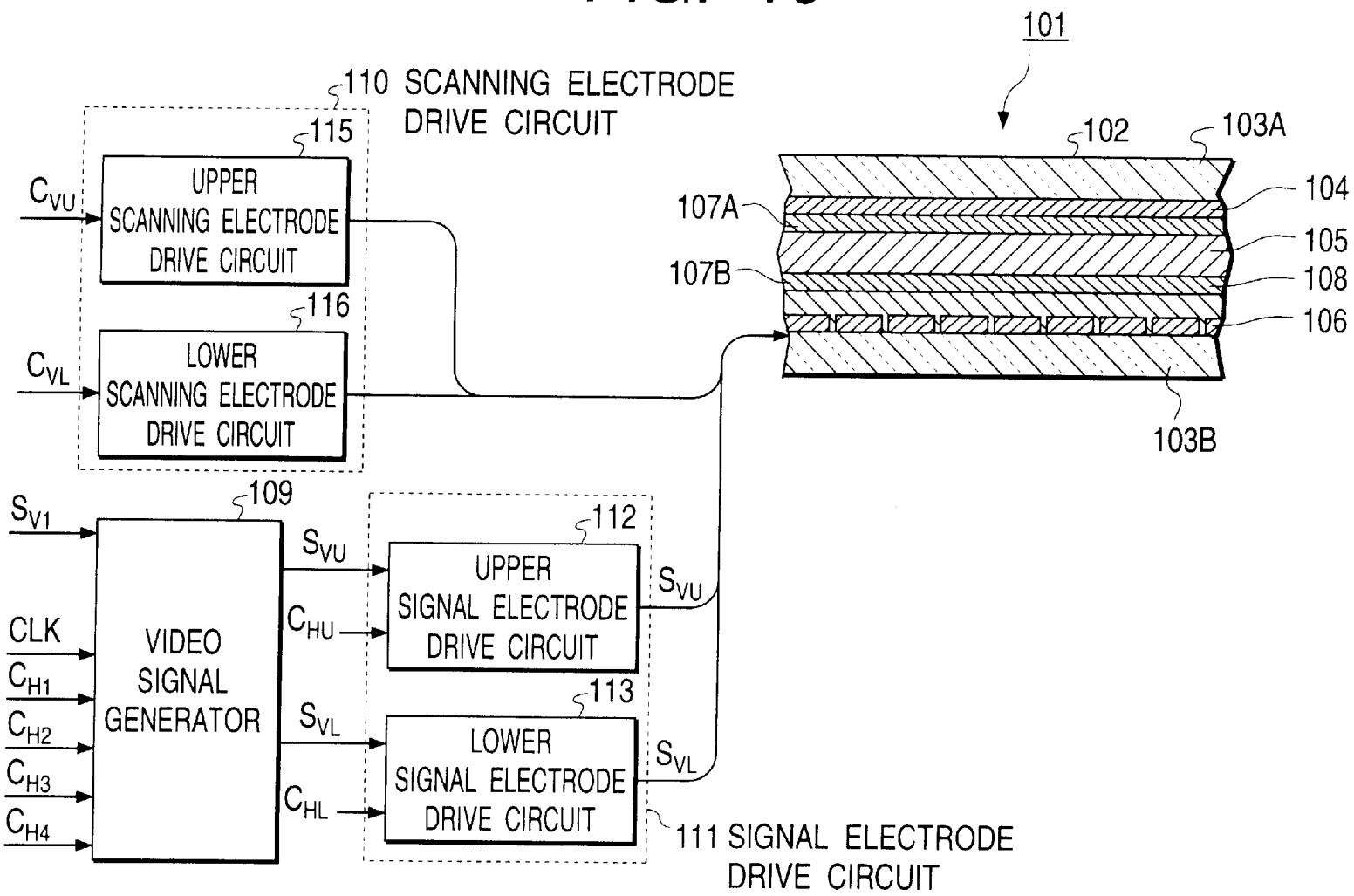
FIG. 10 is a diagram of a liquid-crystal display apparatus according to a fourth embodiment of this invention.

With reference to FIG. 10, a liquid-crystal display apparatus 101 includes a liquid-crystal display panel 102, a video signal generator 109, a scanning-electrode drive circuit 110, and a signal-electrode drive circuit 111. The scanning-electrode drive circuit 110 has an upper scanning-electrode drive circuit 115 and a lower scanning-electrode drive circuit 116. The signal-electrode drive circuit 111 has an upper signal-electrode drive circuit 112 and a lower signal-electrode drive circuit 113.

The liquid-crystal display panel 102 is of a laminate structure. The liquid-crystal display panel 102 includes a pair of upper and lower glass substrates 103A and 103B extending parallel to each other. In the liquid-crystal display panel 102, a transparent electrode 104 having a layer shape extends on an inner surface (a lower surface) of the upper glass substrate 103A. A pair of upper and lower orientation films 107A and 107B extending parallel to each other is located between the transparent electrode 104 and the lower glass substrate 103B. Liquid crystal 105 is fluid-tightly held between the orientation films 107A and 107B. The liquid-crystal display panel 102 includes a matrix array of pixel electrodes 106 extending on an inner surface (an upper surface) of the lower glass substrate 103B. A dielectric mirror 108 having a layer shape is located between the lower orientation film 107B and the matrix array of the pixel electrodes 106.

A plurality of scanning electrodes and a plurality of signal electrodes are formed by a conductive matrix pattern on the inner surface (the upper surface) of the lower glass substrate 103B. It should be noted that the scanning electrodes and the signal electrodes may be formed on a silicon substrate extending on the inner surface of the lower glass substrate 103B. The scanning electrodes extend along an X direction (a matrix row direction or a horizontal direction with respect to a frame). The signal electrodes extend along a Y direction (a matrix column direction or a vertical direction with respect to the frame). Segments of the matrix pattern where the scanning electrodes and the signal electrodes intersect with each other have switching transistors, respectively. Each of the switching transistors is, for example, a MOS transistor formed on the silicon substrate. Each of the switching transistors may be of a TFT type formed on the lower glass substrate 103B.

A scanning electrode, a signal electrode, and a pixel electrode 106 are connected to three terminals of a switching transistor (the gate, the source, and the drain in the case of an FET), respectively. The switching transistor is changed between an ON state (a conductive state) and an OFF state (a non-conductive state) in response to a drive signal fed via the related scanning electrode. When the switching transistor is in its ON state, a video signal $S_{VU}$ or $S_{VL}$ is fed to the related pixel electrode 106 from the related signal electrode via the switching transistor.

As previously described, the scanning-electrode drive circuit 110 has the upper scanning-electrode drive circuit 115 and the lower scanning-electrode drive circuit 116. The upper scanning-electrode drive circuit 115 is designed to drive scanning electrodes in the upper half of the liquid-crystal display panel 102. On the other hand, the lower scanning-electrode drive circuit 116 is designed to drive signal electrodes in the lower half of the liquid-crystal display panel 102.

The upper scanning-electrode drive circuit 115 includes a shift register. The upper scanning-electrode drive circuit 115 receives an upper scanning-electrode control signal $C_{VU}$ from a timing pulse generator. The timing pulse generator includes an oscillator and frequency dividers. The upper scanning-electrode drive circuit 115 sequentially activates the scanning electrodes in the upper half of the liquid-crystal display panel 102 to control the related switching transistors in response to the upper scanning-electrode control signal $C_{VU}$. Time intervals during which the respective scanning electrodes remain activated are equal in length to each other.

The lower scanning-electrode drive circuit 116 includes a shift register. The lower scanning-electrode drive circuit 116 receives a lower scanning-electrode control signal $C_{VL}$ from the timing pulse generator. The lower scanning-electrode drive circuit 116 sequentially activates the scanning electrodes in the lower half of the liquid-crystal display panel 102 to control the related switching transistors in response to the lower scanning-electrode control signal $C_{VL}$. Time intervals during which the respective scanning electrodes remain activated are equal in length to each other.

As previously described, the signal-electrode drive circuit 111 has the upper signal-electrode drive circuit 112 and the lower signal-electrode drive circuit 113. The upper signal-electrode drive circuit 112 is designed to drive signal electrodes in the upper half of the liquid-crystal display panel 102. On the other hand, the lower signal-electrode drive circuit 113 is designed to drive signal electrodes in the lower half of the liquid-crystal display panel 102.

The upper signal-electrode drive circuit 112 includes a shift register. The upper signal-electrode drive circuit 112 receives an upper signal-electrode control signal $C_{HU}$ from the timing pulse generator. The upper signal-electrode drive circuit 112 transmits a video signal $S_{VU}$ from the video signal generator 109 to the related signal electrodes in response to the upper signal-electrode control signal $C_{HU}$. The video signal $S_{VU}$ is indicated by the upper half of the liquid-crystal display panel 102.

The lower signal-electrode drive circuit 113 includes a shift register. The lower signal-electrode drive circuit 113 receives a lower signal-electrode control signal $C_{HL}$ from the timing pulse generator. The lower signal-electrode drive circuit 113 transmits a video signal $S_{VL}$ from the video signal generator 109 to the related signal electrodes in response to the lower signal-electrode control signal $C_{HL}$. The video signal $S_{VL}$ is indicated by the lower half of the liquid-crystal display panel 102.

The video signal generator 109 includes a memory, switches, and polarity inverters. The video signal generator 109 receives a data control signal CLK from the timing pulse generator. The data control signal CLK has a given high frequency. The video signal generator 109 stores and reads a source video signal (an input video signal) $S_{VI}$ into and from the internal memory in response to the data control signal CLK, thereby making the input video signal $S_{VI}$ into a delayed video signal $S_{VM}$. The input video signal $S_{VI}$ sequentially represents fields. The video signal generator 109 receives change control signals $C_{H1}$, $C_{H2}$, $C_{H3}$, and $C_{H4}$ from the timing pulse generator. The video signal generator 109 changes the input video signal $S_{VI}$ and the delayed video signal $S_{VM}$ in response to the change control signals $C_{H1}$, $C_{H2}$, $C_{H3}$, and $C_{H4}$, thereby converting the input video signal $S_{VI}$ and the delayed video signal $S_{VM}$ into the video signals $S_{VU}$ and $S_{VL}$. The video signal generator 109 feeds the video signals $S_{VU}$ and $S_{VL}$ to the upper signal-electrode drive circuit 112 and the lower signal-electrode drive circuit 113, respectively.

Figure 11:
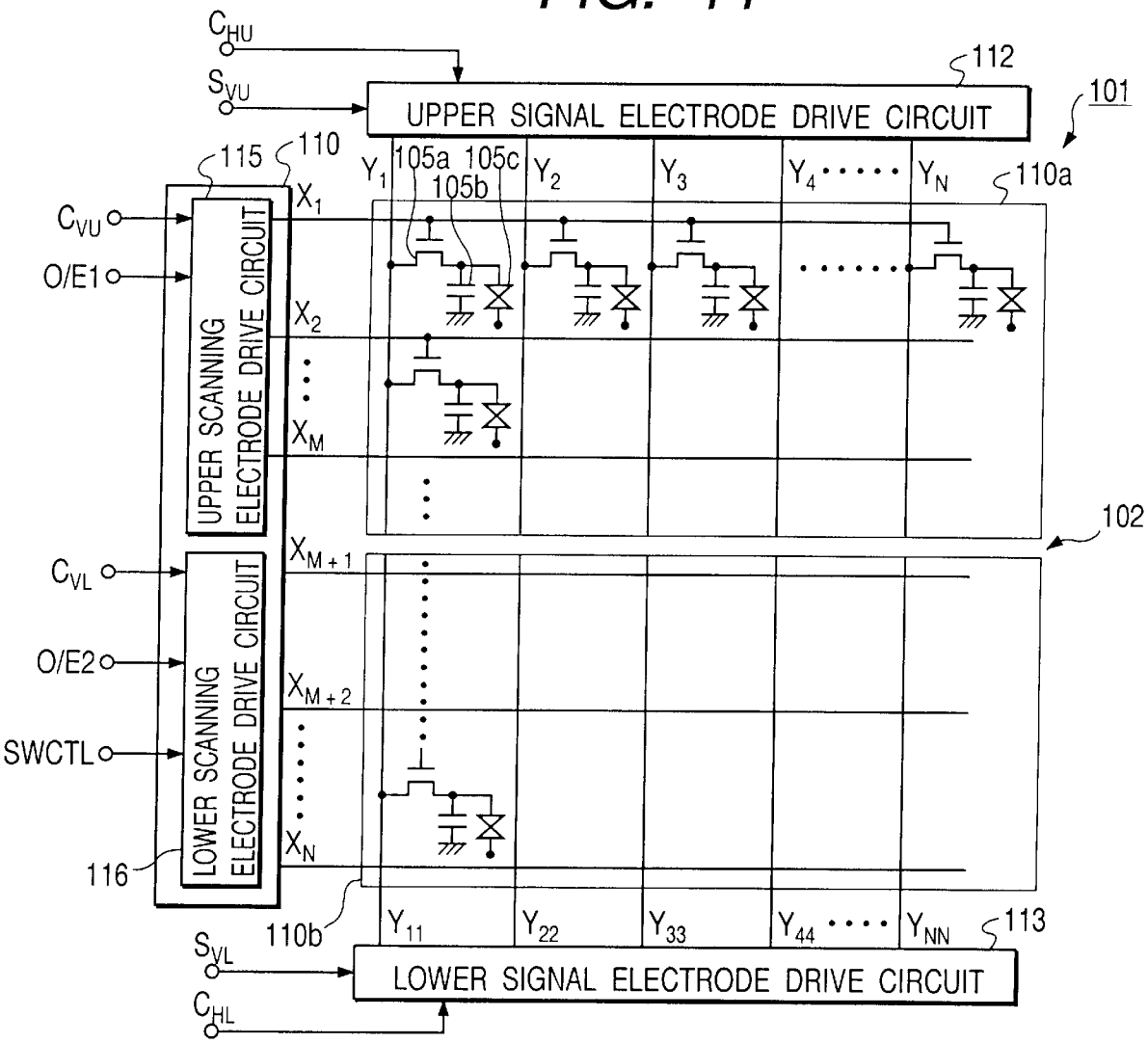
FIG. 11 is another diagram of the liquid-crystal display apparatus according to the fourth embodiment of this invention.

As shown in FIG. 11, the liquid-crystal display apparatus 101 includes a plurality of upper scanning electrodes $X_1, X_2, \ldots, X_M$, a plurality of lower scanning electrodes $X_{M+1}, X_{M+2}, \ldots, X_N$, a plurality of upper signal electrodes $Y_1, Y_2, \ldots, Y_N$, and a plurality of lower signal electrodes $Y_{11}, Y_{22}, \ldots, Y_{NN}$. Here, "M" and "N" denote given natural numbers respectively. The number "M" is equal to, for example, a half of the number "N". The upper scanning electrodes $X_1, X_2, \ldots, X_M$ extend along matrix rows. Also, the lower scanning electrodes $X_{M+1}, X_{M+2}, \ldots, X_N$ extend along matrix rows. The upper signal electrodes $Y_1, Y_2, \ldots, Y_N$ extend along matrix columns. Also, the lower signal electrodes $Y_{11}, Y_{22}, \ldots, Y_{NN}$ extend along matrix columns.

Segments of a matrix where the upper scanning electrodes $X_1, X_2, \ldots, X_M$, the lower scanning electrodes $X_{M+1}, X_{M+2}, \ldots, X_N$, the upper signal electrodes $Y_1, Y_2, \ldots, Y_N$, and the lower signal electrodes $Y_1, Y_{22}, \ldots, Y_{NN}$ intersect with each other have switching transistors 105*a*, respectively. One end of the switching transistors 105*a* are connected to pixel electrodes 106 (see FIG. 10) respectively. One end of the switching transistors 105*a* are also connected to capacitors 105*b* respectively. Each capacitor 105*b* serves to store a 1-pixel-corresponding segment of a video signal $S_{VU}$ or $S_{VL}$. In addition, each capacitor 105*b* continuously subjects a 1-pixel-corresponding portion of the liquid crystal 105 to a signal voltage (an electric field) depending on the 1-pixel-corresponding segment of the video signal $S_{VU}$ or $S_{VL}$. The application of the signal voltage (the electric field) to the 1-pixel-corresponding portion of the liquid crystal 5 is implemented via the pixel electrode 106 (see FIG. 10).

The liquid-crystal display panel 102 is divided into upper and lower halves 110*a* and 110*b* corresponding to upper and lower halves of a field respectively. The upper half 110*a* of the liquid-crystal display panel 102 contains the upper scanning electrodes $X_1, X_2, \ldots, X_M$. The lower half 110*b* of the liquid-crystal display panel 102 contains the lower scanning electrodes $X_{M+1}, X_{M+2}, \ldots, X_N$. The upper half 110*a* of the liquid-crystal display panel 102 contains the upper signal electrodes $Y_1, Y_2, \ldots, Y_N$. The lower half 110*b* of the liquid-crystal display panel 102 contains the lower signal electrodes $Y_{11}, Y_{22}, \ldots, Y_{NN}$.

The upper scanning-electrode drive circuit 115 is connected to the upper scanning electrodes $X_1, X_2, \ldots, X_M$. The lower scanning-electrode drive circuit 116 is connected to the lower scanning electrodes $X_{M+1}, X_{M+2}, \ldots, X_N$. The upper signal-electrode drive circuit 112 is connected to the upper signal electrodes $Y_1, Y_2, \ldots, Y_N$ which intersect with the upper scanning electrodes $X_1, X_2, \ldots, X_M$. The lower signal-electrode drive circuit 113 is connected to the lower signal electrodes $Y_{11}, Y_{22}, \ldots, Y_{NN}$ which intersect with the lower scanning electrodes $X_{M+1}, X_{M+2}, \ldots, X_N$.

The upper scanning-electrode drive circuit 115 feeds drive signals to the upper scanning electrodes $X_1, X_2, \ldots, X_M$ at different timings in response to an upper scanning-electrode control signal $C_{VU}$ and a field change signal O/E1, respectively. The lower scanning-electrode drive circuit 116 feeds drive signals to the lower scanning electrodes $X_{M+1}, X_{M+2}, \ldots, X_N$ at different timings in response to a lower scanning-electrode control signal $C_{VL}$ and a field change signal O/E2. The lower scanning-electrode drive circuit 116 receives a set control signal SWCTL which remains fixed in a given state. The upper signal-electrode drive circuit 112 feeds time segments of the video signal $S_{VU}$ to the upper signal electrodes $Y_1, Y_2, \ldots, Y_N$ in response to an upper signal-electrode control signal $C_{HU}$, respectively. The lower signal-electrode drive circuit 113 feeds time segments of the video signal $S_{VL}$ to the lower signal electrodes $Y_{11}, Y_{22}, \ldots, Y_{NN}$ in response to a lower signal-electrode control signal $C_{HL}$, respectively.

Summary of operation of the liquid-crystal display apparatus 101 of FIGS. 10 and 11 is as follows. During the former half of a 1-field interval, an input video signal representing the upper half of a present field is directly fed to the upper half 110*a* of the liquid-crystal display panel 102 while a video signal representing the lower half of a previous field is fed from a memory to the lower half 110*b* of the liquid-crystal display panel 102. During the latter half of the 1-field interval, an input video signal representing the lower half of the present field is directly fed to the lower half 110*b* of the liquid-crystal display panel 102 while a video signal representing the upper half of the present field is fed from the memory to the upper half 110*a* of the liquid-crystal display panel 2. These processes are reiterated. The memory delays the input video signal by a time interval corresponding to a half of a field. The polarity of the video signal $S_{VU}$ fed to the upper half 110*a* of the liquid-crystal display panel 102 is inverted every half field. Also, the polarity of the video signal $S_{VL}$ fed to the lower half 110*b* of the liquid-crystal display panel 102 is inverted every half field.

When the total number of the scanning electrodes $X_1, X_2, \ldots, X_N$ is even, it is preferable to equalize the number of scanning electrodes contained in the upper half 110*a* of the liquid-crystal display panel 102 and the number of scanning electrodes contained in the lower half 110*b* thereof. When the total number of the scanning electrodes $X_1, X_2, \ldots, X_N$ is odd, it is preferable that the number of scanning electrodes contained in the upper half 110*a* of the liquid-crystal display panel 102 differs from the number of scanning electrodes contained in the lower half 110*b* thereof by one.

Figure 12:
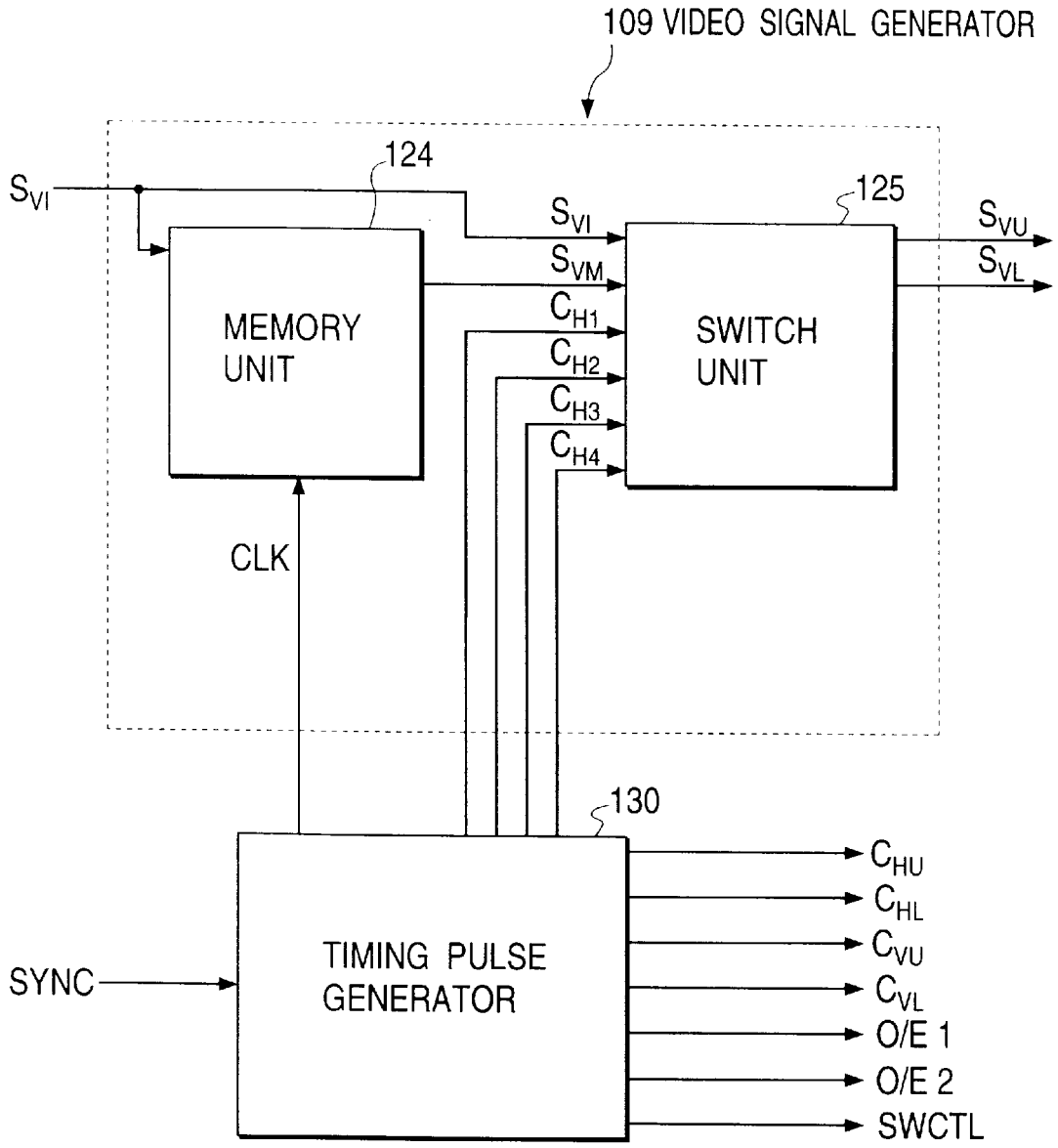
FIG. 12 is a block diagram of a video signal generator in FIG. 10 and a timing pulse generator.

As shown in FIG. 12, the video signal generator 109 includes a memory unit 124 and a switch unit 125. The input side of the switch unit 125 is connected to the output side of the memory unit 124. The output side of the switch unit 125 is connected to the upper signal-electrode drive circuit 112 and the lower signal-electrode drive circuit 113 (see FIG. 10).

As shown in FIG. 12, a timing pulse generator 130 receives a reference clock signal or a basic clock signal SYNC having a given high frequency. The timing pulse generator 130 includes an oscillator responsive to the reference clock signal SYNC, frequency dividers responsive to the output signal of the oscillator, and inverters responsive to the output signals of given frequency dividers selected from among all the frequency dividers. The oscillator, the frequency dividers, and the inverters in the timing pulse generator 130 cooperate to generate the change control signals $C_{H1}$, $C_{H2}$, $C_{H3}$, and $C_{H4}$, the data control signal CLK, the upper signal-electrode control signal $C_{HU}$, the lower signal-electrode control signal $C_{HL}$, the upper scanning-electrode control signal $C_{VU}$, the lower scanning-electrode control signal $C_{VL}$, the field change signals O/E1 and O/E2, and the set control signal SWCTL in response to the reference clock signal SYNC. The timing pulse generator 130 outputs these generated signals.

With reference to FIG. 12, an input video signal (a source video signal) $S_{VI}$ is applied to the memory unit 124 and the switch unit 125. The memory unit 124 receives the data control signal CLK from the timing pulse generator 130. The input video signal $S_{VI}$ is temporarily stored in the memory unit 124 in response to the data control signal CLK before being outputted from the memory unit 124 to the switch unit 125 as a delayed video signal $S_{VM}$. The video signal $S_{VM}$ is delayed from the input video signal $S_{VI}$ by a time interval corresponding to a half of a field.

The switch unit 125 receives the change control signals $C_{H1}$, $C_{H2}$, $C_{H3}$, and $C_{H4}$ from the timing pulse generator. The switch unit 125 periodically executes a change between the input video signal $S_{VI}$ and the delayed video signal $S_{VM}$ in response to the change control signals $C_{H1}$ and $C_{H2}$. The switch unit 125 periodically inverts the polarities of the change-resultant video signals in response to the change control signals $C_{H3}$ and $C_{H4}$, thereby generating the video signals $S_{VU}$ and $S_{VL}$. The switch unit 125 outputs the video signals $S_{VU}$ and $S_{VL}$ to the upper signal-electrode drive circuit 112 and the lower signal-electrode drive circuit 113 (see FIG. 10), respectively.

Figure 13:
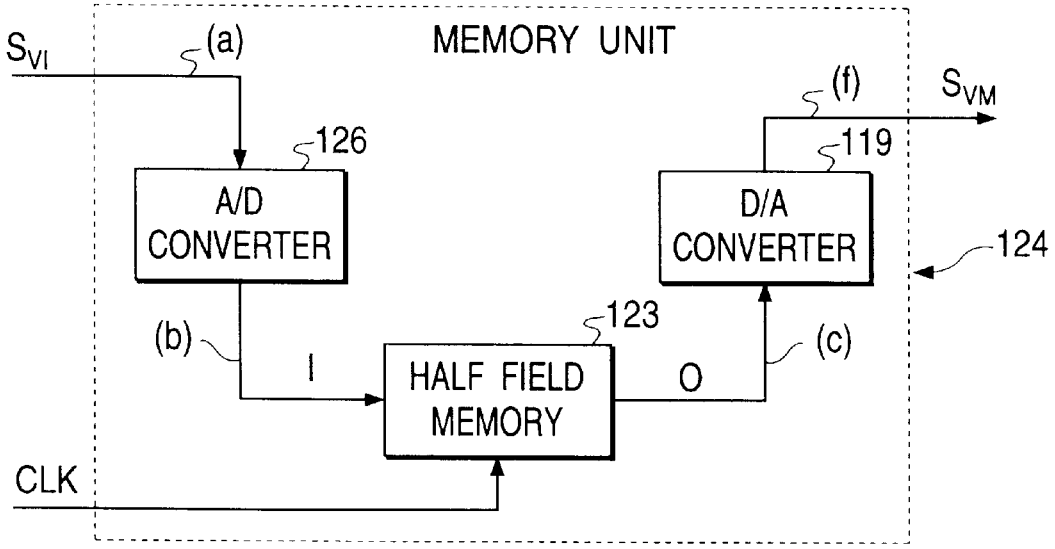
FIG. 13 is a block diagram of a memory unit in FIG. 12.

As shown in FIG. 13, the memory unit 124 includes an A/D (analog-to-digital) converter 126, a memory 123, and a D/A (digital-to-analog) converter 119. The input terminal of the A/D converter 126 receives an input video signal $S_{VI}$. The output terminal of the A/D converter 126 is connected to the input side of the memory 123. The memory 123 has a capacity corresponding to a half of a field represented by the input video signal $S_{VI}$. The memory 123 receives the data control signal CLK from the timing pulse generator 130 (see FIG. 12). The output side of the memory 123 is connected to the input terminal of the D/A converter 119. The output terminal of the D/A converter 119 is connected to the switch unit 125 (see FIG. 12).

The A/D converter 126 changes the input video signal $S_{VI}$ into a corresponding digital video signal. The A/D converter 126 outputs the digital video signal to the memory 123. Samples of the digital video signal are written into and read out from the memory 123 on a time division basis in response to the data control signal CLK. Thereby, the memory 123 serves to delay the digital video signal by a time interval corresponding to a half of a field. The digital video signal read out from the memory 123 is fed to the D/A converter 119. The D/A converter 119 changes the received digital video signal into a corresponding analog video signal $S_{VM}$. The resultant video signal $S_{VM}$ is delayed from the input video signal $S_{VI}$ by a time interval corresponding to a half of a field. The D/A converter 119 outputs the video signal $S_{VM}$ to the switch unit 125 (see FIG. 12).

Figure 14:
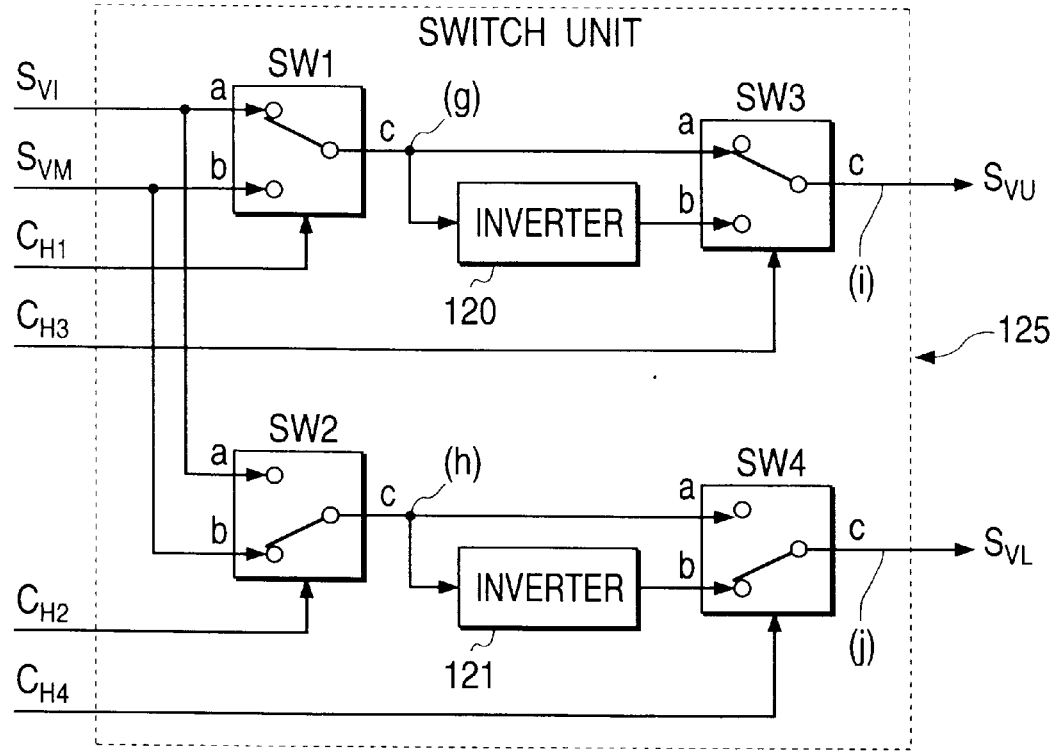
FIG. 14 is a block diagram of a switch unit in FIG. 12.

As shown in FIG. 14, the switch unit 125 includes switches SW1, SW2, SW3, and SW4, and polarity inverters 120 and 121. A first fixed contact "a" of the switch SW1 receives the input video signal $S_{VI}$. A second fixed contact "b" of the switch SW1 receives the video signal $S_{VM}$ from the memory unit 124 (see FIG. 12). The switch SW1 has a movable contact "c" which selectively touches one of the fixed contacts "a" and "b" thereof. The switch SW1 has a control terminal subjected to the change control signal $C_{H1}$. The movable contact "c" of the switch SW1 leads to the input terminal of the inverter 120 and also a first fixed contact "a" of the switch SW3. The output terminal of the inverter 120 is connected to a second fixed contact "b" of the switch SW3. The switch SW3 has a movable contact "c" which selectively touches one of the fixed contacts "a" and "b" thereof. The switch SW3 has a control terminal subjected to the change control signal $C_{H3}$. The movable contact "c" of the switch SW3 is connected to the upper signal-electrode drive circuit 112 (see FIG. 10).

A first fixed contact "a" of the switch SW2 receives the input video signal $S_{VI}$. A second fixed contact "b" of the switch SW2 receives the video signal $S_{VM}$ from the memory unit 124 (see FIG. 12). The switch SW2 has a movable contact "c" which selectively touches one of the fixed contacts "a" and "b" thereof. The switch SW2 has a control terminal subjected to the change control signal $C_{H2}$. The movable contact "c" of the switch SW2 leads to the input terminal of the inverter 121 and also a first fixed contact "a" of the switch SW4. The output terminal of the inverter 121 is connected to a second fixed contact "b" of the switch SW4. The switch SW4 has a movable contact "c" which selectively touches one of the fixed contacts "a" and "b" thereof. The switch SW4 has a control terminal subjected to the change control signal $C_{H4}$. The movable contact "c" of the switch SW4 is connected to the lower signal-electrode drive circuit 113 (see FIG. 10).

The switch SW1 selects one out of the video signals $S_{VI}$ and $S_{VM}$ in response to the change control signal $C_{H1}$, and outputs the selected video signal to the inverter 120 and the switch SW3. The device 120 inverts the polarity of the output signal of the switch SW1. The output signal of the inverter 120 is fed to the switch SW3. The switch SW3 selects one out of the output signal of the switch SW1 and the output signal of the inverter 120 in response to the change control signal $C_{H3}$, and outputs the selected signal as the video signal $S_{VU}$. The switch SW2 selects one out of the video signals $S_{VI}$ and $S_{VM}$ in response to the change control signal $C_{H2}$, and outputs the selected video signal to the inverter 121 and the switch SW4. The device 121 inverts the polarity of the output signal of the switch SW2. The output signal of the inverter 121 is fed to the switch SW4. The switch SW4 selects one out of the output signals of the switch SW2 and the output signal of the invexter 121 in response to the change control signal $C_{H4}$, and outputs the selected signal as the video signal $S_{VL}$.

During the former half of every 1-field interval, the switch SW1 selects the video signal $S_{VI}$ in response to the change control signal $C_{H1}$, and outputs the selected video signal $S_{VI}$ to the inverter 120 and the switch SW3. The switch SW3 selects the output signal of the switch SW1, that is, the video signal $S_{VI}$. The switch SW3 outputs the selected video signal $S_{VI}$ as a positive-polarity video signal $S_{VU}$. During the former half of every 1-field interval, the switch SW2 selects the video signal $S_{VM}$ in response to the change control signal $C_{H2}$, and outputs the selected video signal $S_{VM}$ to the inverter 121 and the switch SW4. The device 121 inverts the polarity of the video signal $S_{VM}$. The inverter 121 outputs the polarity inversion of the video signal $S_{VM}$ to the switch SW4. The switch SW4 selects the output signal of the inverter 121, that is, the polarity inversion of the video signal $S_{VM}$. The switch SW4 outputs the polarity inversion of the video signal $S_{VM}$ as a negative-polarity video signal $S_{VL}$.

During the latter half of every 1-field interval, the switch SW1 selects the video signal $S_{VM}$ in response to the change control signal $C_{H1}$, and outputs the selected video signal $S_{VM}$ to the inverter 120 and the switch SW3. The device 120 inverts the polarity of the video signal $S_{VM}$. The inverter 120 outputs the polarity inversion of the video signal $S_{VM}$ to the switch SW3. The switch SW3 selects the output signal of the inverter 120, that is, the polarity inversion of the video signal $S_{VM}$. The switch SW3 outputs the polarity inversion of the video signal $S_{VM}$ as a negative-polarity video signal $S_{VU}$. During the latter half of every 1-field interval, the switch SW2 selects the video signal $S_{VI}$ in response to the change control signal $C_{H2}$, and outputs the selected video signal $S_{VI}$ to the inverter 121 and the switch SW4. The switch SW4 selects the output signal of the switch SW2, that is, the video signal $S_{VI}$. The switch SW4 outputs the video signal $S_{VI}$ as a positive-polarity video signal $S_{VL}$.

In this way, the polarity of the video signal $S_{VU}$ outputted from the switch unit 125 is inverted every half field. Also, the polarity of the video signal $S_{VL}$ outputted from the switch unit 125 is inverted every half field. In other words, the video signals $S_{VU}$ and $S_{VL}$ change between the positive polarity and the negative polarity at a frequency corresponding to the field frequency of the input video signal $S_{VI}$. In the case where the field frequency is 60 Hz, the polarity change of the video signals $S_{VU}$ and $S_{VL}$ has a frequency of 60 Hz. Furthermore, the polarities of the video signals $S_{VL}$ and $S_{VU}$ are always opposite to each other.

Figure 15:
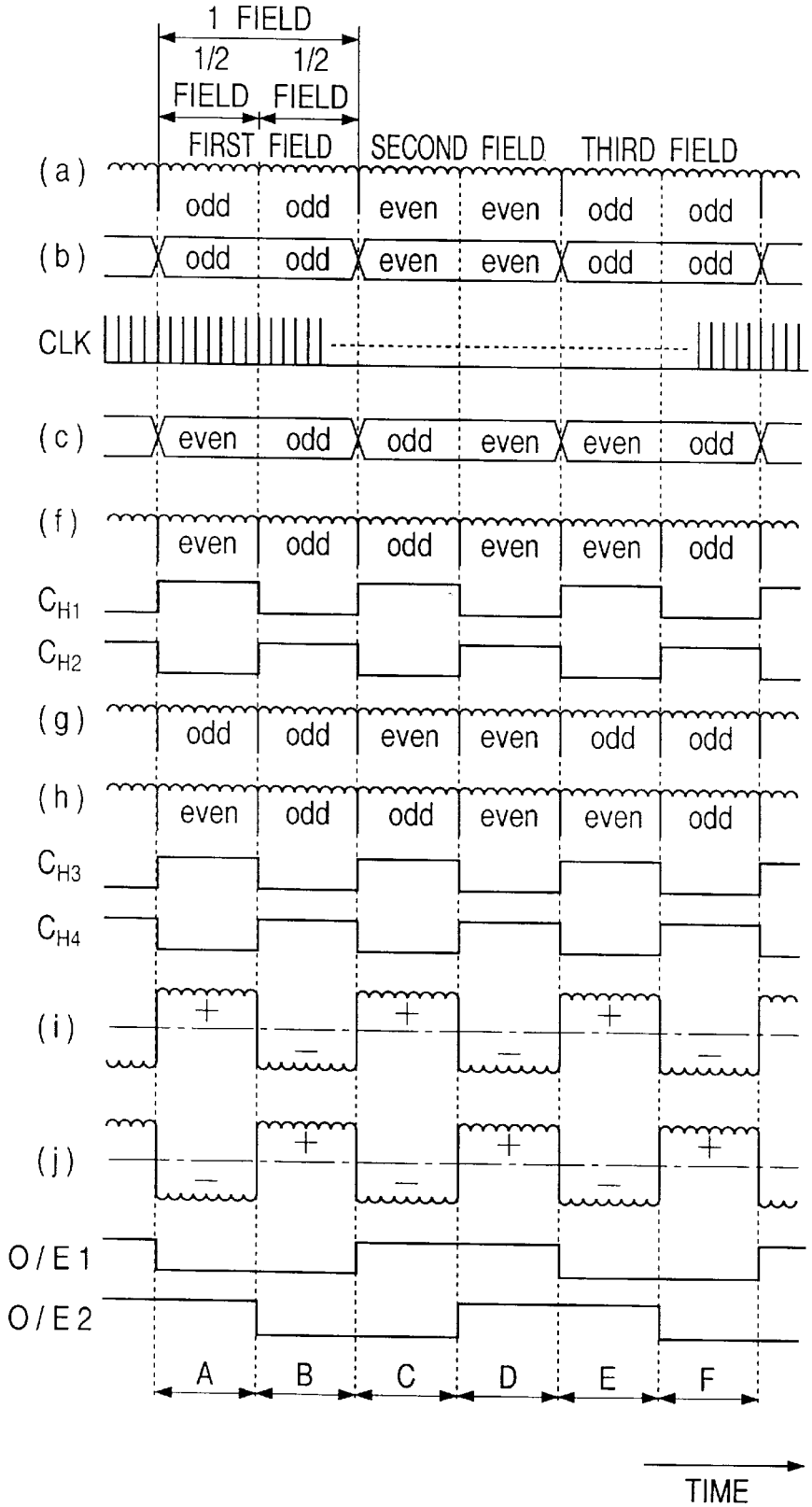
FIG. 15 is a time-domain diagram of various signals in the apparatus of FIGS. 10 and 11.

The input side (a) of the A/D converter 126 (see FIG. 13) is subjected to the input video signal $S_{VI}$ which has a waveform such as shown by the portion (a) of FIG. 15. The input video signal $S_{VI}$ has a sequence of 1-field corresponding segments. The output side (b) of the A/D converter 126 is subjected to the digital version of the input video signal $S_{VI}$ which has a sequence of 1-field corresponding segments as shown in the portion (b) of FIG. 15. The data control signal CLK fed to the memory 123 (see FIG. 13) periodically changes between a high level and a low level at a given high frequency as shown in the portion CLK of FIG. 15. The output side (c) of the memory 123 is subjected to the output video signal from the memory 123 which is delayed from the digital version of the input video signal $S_{VI}$ by a time interval corresponding to a half of a field as shown in the portion (c) of FIG. 15. The output side (f) of the D/A converter 119 (see FIG. 13) is subjected to the analog version of the output video signal from the memory 123 as shown in the potion (f) of FIG. 15. The analog version of the output video signal from the memory 123 is the video signal $S_{VM}$ which is delayed from the input video signal $S_{VI}$ by a time interval corresponding to a half of a field.

The change control signal $C_{H1}$ fed to the switch SW1 (see FIG. 14) periodically changes between a high level and a low level as shown in the portion $C_{H1}$ of FIG. 15. During the former half of every 1-field interval, the change control signal $C_{H1}$ is in the high-level state so that the switch SW1 selects the video signal $S_{VI}$. During the latter half of every 1-field interval, the change control signal $C_{H1}$ is in the low-level state so that the switch SW1 selects the video signal $S_{VM}$. The change control signal $C_{H2}$ fed to the switch SW2 (see FIG. 14) periodically changes between a high level and a low level as shown in the portion $C_{H2}$ of FIG. 15. During the former half of every 1-field interval, the change control signal $C_{H2}$ is in the low-level state so that the switch SW2 selects the video signal $S_{VM}$. During the latter half of every 1-field interval, the change control signal $C_{H2}$ is in the high-level state so that the switch SW2 selects the video signal $S_{VI}$. The output side (g) of the switch SW1 is subjected to the output video signal from the switch SW1 which has a waveform such as shown in the portion (g) of FIG. 15. Specifically, the output video signal from the switch SW1 agrees with the input video signal (the non-delayed video signal) $S_{VI}$ during the former half of every 1-field interval, and agrees with the delayed video signal $S_{VM}$ during the latter half of every 1-field interval. The output side (h) of the switch SW2 is subjected to the output video signal from the switch SW2 which has a waveform such as shown in the portion (h) of FIG. 15. Specifically, the output video signal from the switch SW2 agrees with the delayed video signal $S_{VM}$ during the former half of every 1-field interval, and agrees with the input video signal (the non-delayed video signal) $S_{VI}$ during the latter half of every 1-field interval.

The change control signal $C_{H3}$ fed to the switch SW3 (see FIG. 14) periodically changes between a high level and a low level as shown in the portion $C_{H3}$ of FIG. 15. During the former half of every 1-field interval, the change control signal $C_{H3}$ is in the high-level state so that the switch SW3 selects the output signal of the switch SW1, that is, the positive-polarity non-delayed video signal $S_{VI}$. During the latter half of every 1-field interval, the change control signal $C_{H3}$ is in the low-level state so that the switch SW3 selects the output signal of the inverter 120, that is, the negative-polarity delayed video signal $S_{VM}$. The change control signal $C_{H4}$ fed to the switch SW4 (see FIG. 14) periodically changes between a high level and a low level as shown in the portion $C_{H4}$ of FIG. 15. During the former half of every 1-field interval, the change control signal $C_{H4}$ is in the low-level state so that the switch SW4 selects the output signal of the inverter 121, that is, the negative-polarity delayed video signal $S_{VM}$. During the latter half of every 1-field interval, the change control signal $C_{H4}$ is in the high-level state so that the switch SW4 selects the output signal of the switch SW2, that is, the positive-polarity non-delayed video signal $S_{VI}$. The output side (i) of the switch SW3 is subjected to the output video signal from the switch SW3 which has a waveform such as shown in the portion (i) of FIG. 15. The output video signal from the switch SW3 agrees with the video signal $S_{VU}$. The output video signal from the switch SW3, that is, the video signal $S_{VU}$, has a positive polarity during the former half of every 1-field interval, and has a negative polarity during the latter half of every 1-field interval. The output side (j) of the switch SW4 is subjected to the output video signal from the switch SW4 which has a waveform such as shown in the portion (j) of FIG. 15. The output video signal from the switch SW4 agrees with the video signal $S_{VL}$. The output video signal from the switch SW4, that is, the video signal $S_{VL}$, has a negative polarity during the former half of every 1-field interval, and has a positive polarity during the latter half of every 1-field interval.

In the liquid-crystal display apparatus 101, the video signal generator 109 outputs the video signal $S_{VU}$ to the upper signal-electrode drive circuit 112. The upper signal-electrode drive circuit 112 feeds time segments of the video signal $S_{VU}$ to the upper signal electrodes $Y_1, Y_2, \ldots, Y_N$ in response to the upper signal-electrode control signal $C_{HU}$, respectively. In addition, the video signal generator 109 outputs the video signal $S_{VL}$ to the lower signal-electrode drive circuit 113. The lower signal-electrode drive circuit 113 feeds time segments of the video signal $S_{VL}$ to the lower signal electrodes $Y_{11}, Y_{22}, \ldots, Y_{NN}$ in response to the lower signal-electrode control signal $C_{HL}$, respectively. The polarity of each of the video signals $S_{VU}$ and $S_{VL}$ fed to the signal electrodes $Y_1, Y_2, \ldots, Y_N$ and the signal electrodes $Y_{11}, Y_{22}, \ldots, Y_{NN}$ is inverted every half field. Accordingly, the polarity of each of the video signals $S_{VU}$ and $S_{VL}$ during the former half of every 1-field interval is opposite to that during the latter half of every 1-field interval. Thus, the matrix of the 1-pixel corresponding portions of the liquid crystal 105 is driven by an ac voltage having a frequency equal to the field frequency of the input video signal $S_{VI}$. In the case where the field frequency is 60 Hz, the matrix of the 1-pixel-corresponding portions of the liquid crystal 105 is driven at a frequency of 60 Hz. Accordingly, the frequency of the ac drive voltage for the matrix in the liquid-crystal display apparatus 101 is equal to twice the frequency of the ac drive voltage for the matrix in the prior-art apparatus of FIG. 1. Thus, the liquid-crystal display apparatus 101 is advantageous over the prior-art apparatus of FIG. 1 in suppressing a fficker of an indicated picture.

Figure 16:
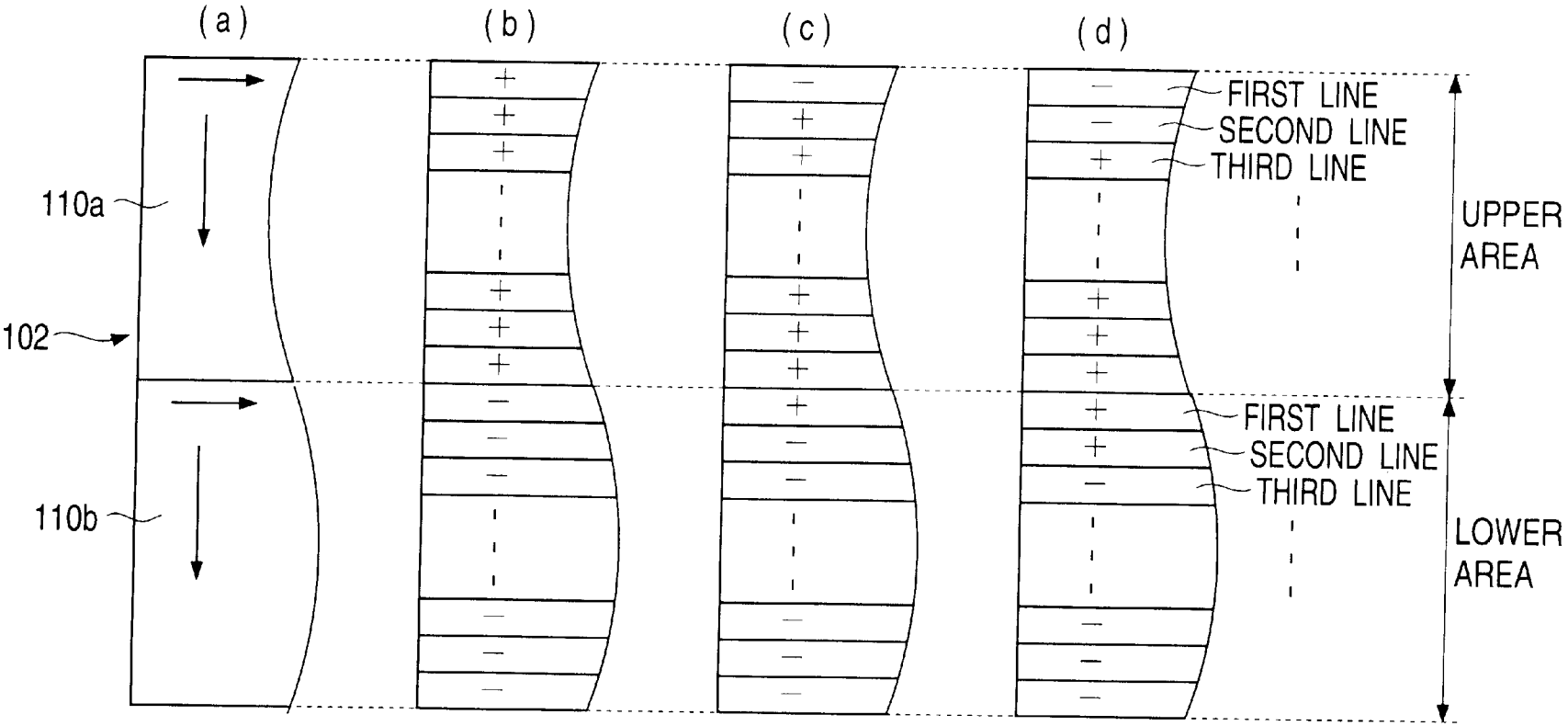
FIG. 16 is a time-domain diagram of conditions of a liquid-crystal display panel in FIGS. 10 and 11.

With reference to the portion (a) of FIG. 16, the video signals $S_{VU}$ and $S_{VL}$ are simultaneously written into the upper and lower halves 110*a* and 110*b* of the liquid-crystal display panel 102, respectively. During every half-fleld interval, the writing of the video signal $S_{VU}$ starts from the uppermost line (the uppermost matrix row) in the upper half 110*a* of the liquid-crystal display panel 102 while the writing of the video signal $S_{VL}$ starts from the uppermost line (the uppermost matrix row) in the lower half 110*a* of the liquid-crystal display panel 102.

As shown in the portion (b) of FIG. 16, at an end of the former half of every 1-field interval, the positive-polarity video signal $S_{VU}$ has been written into all the lines (the matrix rows) in the upper half 110*a* of the liquid-crystal display panel 102 and the negative-polarity video signal $S_{VL}$ has been written into all the lines (the matrix rows) in the lower half 110*b* of the liquid-crystal display panel 102. In this case, the lowermost line of the upper half 110*a* of the liquid-crystal display panel 102 and the uppermost line of the lower half 110*b* of the liquid-crystal display panel 102, which neighbor each other, are loaded with video signals having opposite polarities. This condition tends to cause disclination, which can be substantially prevented from raising a problem since the end of the former half of every 1-field interval corresponds to a blanking period.

As shown in the portion (c) of FIG. 16, at a start of the latter half of every 1-field interval, the negative-polarity video signal $S_{VU}$ has been written into the uppermost line in the upper half 110*a* of the liquid-crystal display panel 102 and the positive-polarity video signal $S_{VL}$ has been written into the uppermost line in the lower half 110*b* of the liquid-crystal display panel 102. In this case, the lowermost line of the upper half 110*a* of the liquid-crystal display panel 102 and the uppermost line of the lower half 110*b* of the liquid-crystal display panel 102, which neighbor each other, are loaded with video signals having equal polarities. This condition prevents the occurrence of disclination which would decrease the quality of an indicated picture. Thereafter, as shown in the portion (d) of FIG. 16, the negative-polarity video signal $S_{VU}$ is written into the second uppermost line in the upper half 110*a* of the liquid-crystal display panel 102 and the positive-polarity video signal $S_{VL}$ is written into the second uppermost line in the lower half 110*b* of the liquid-crystal display panel 102.

The lines (the matrix rows) in the upper half 110*a* of the liquid-crystal display panel 102 are separated into sets each having only one line or two neighboring lines. Lines in a common set are simultaneously activated and are thus driven by a same time segment of the video signal $S_{VU}$. The separation of the lines into the sets is changed in response to the field change signal O/E1. As shown in the portions A and B of FIG. 17, during a first 1-field interval, the lines in the upper half 110*a* of the liquid-crystal display panel 102 except the uppermost line and the lowermost line are separated into sets each having two neighboring lines. The lowermost line forms another set. The uppermost line remains deactivated, and does not form any set. During the first 1-field interval, the sets are driven by time segments of the video signal $S_{VU}$ respectively. As shown in the portions C and D of FIG. 17, during a second 1-field interval, the lines in the upper half 110*a* of the liquid-crystal display panel 102 which include the uppermost line and the lowermost line are separated into sets each having two neighboring lines. During the second 1-field interval, the sets are driven by time segments of the video signal $S_{VU}$ respectively. As shown in the portions E and F of FIG. 17, conditions which occur during a third 1-field interval are similar to those occurring during the first 1-field interval.

The lines (the matrix rows) in the lower half 110*b* of the liquid-crystal display panel 102 are separated into sets each having only one line, two neighboring lines, or three neighboring lines. Lines in a common set are simultaneously activated and are thus driven by a same time segment of the video signal $S_{VL}$. The separation of the lines into the sets is changed in response to the field change signal O/E2. As shown in the portion A of FIG. 17, during the former half of a first 1-field interval, the lines in the lower half 110*b* of the liquid-crystal display panel 102 are separated into sets each having two neighboring lines. During the former half of the first 1-field interval, the sets are driven by time segments of the video signal $S_{VL}$ respectively. As shown in the portions B and C of FIG. 17, during the latter half of the first 1-field interval and the former half of a second 1-field interval, the lines in the lower half 110*b* of the liquid-crystal display panel 102 except the uppermost line, the second uppermost line, the third uppermost line, and the lowermost line are separated into sets each having two neighboring lines. The uppermost line, the second uppermost line, and the third uppermost line compose another set. The lowermost line forms still another set. During the latter half of the first 1-field interval and the former half of the second 1-field interval, the sets are driven by time segments of the video signal $S_{VL}$ respectively. Accordingly, in this case, the uppermost line in the lower half 110*b* of the liquid-crystal display panel 102 keeps prevented from being deactivated. Thus, a linearly-extending ineffective (meaningless) region is prevented from occurring along the boundary between the upper and lower halves 110*a* and 110*b* of the liquid-crystal display panel 102. As shown in the portions D and E of FIG. 17, during the latter half of the second 1-field interval and the former half of a third 1-field interval, the lines in the lower half 110*b* of the liquid-crystal display panel 102 are separated into sets each having two neighboring lines. During the latter half of the second 1-field interval and the former half of the third 1-field interval, the sets are driven by time segments of the video signal $S_{VL}$ respectively. As shown in the portion F of FIG. 17, conditions which occur during the latter half of the third 1-field interval are similar to those occurring during the latter half of the first 1-field interval.

Figure 18:
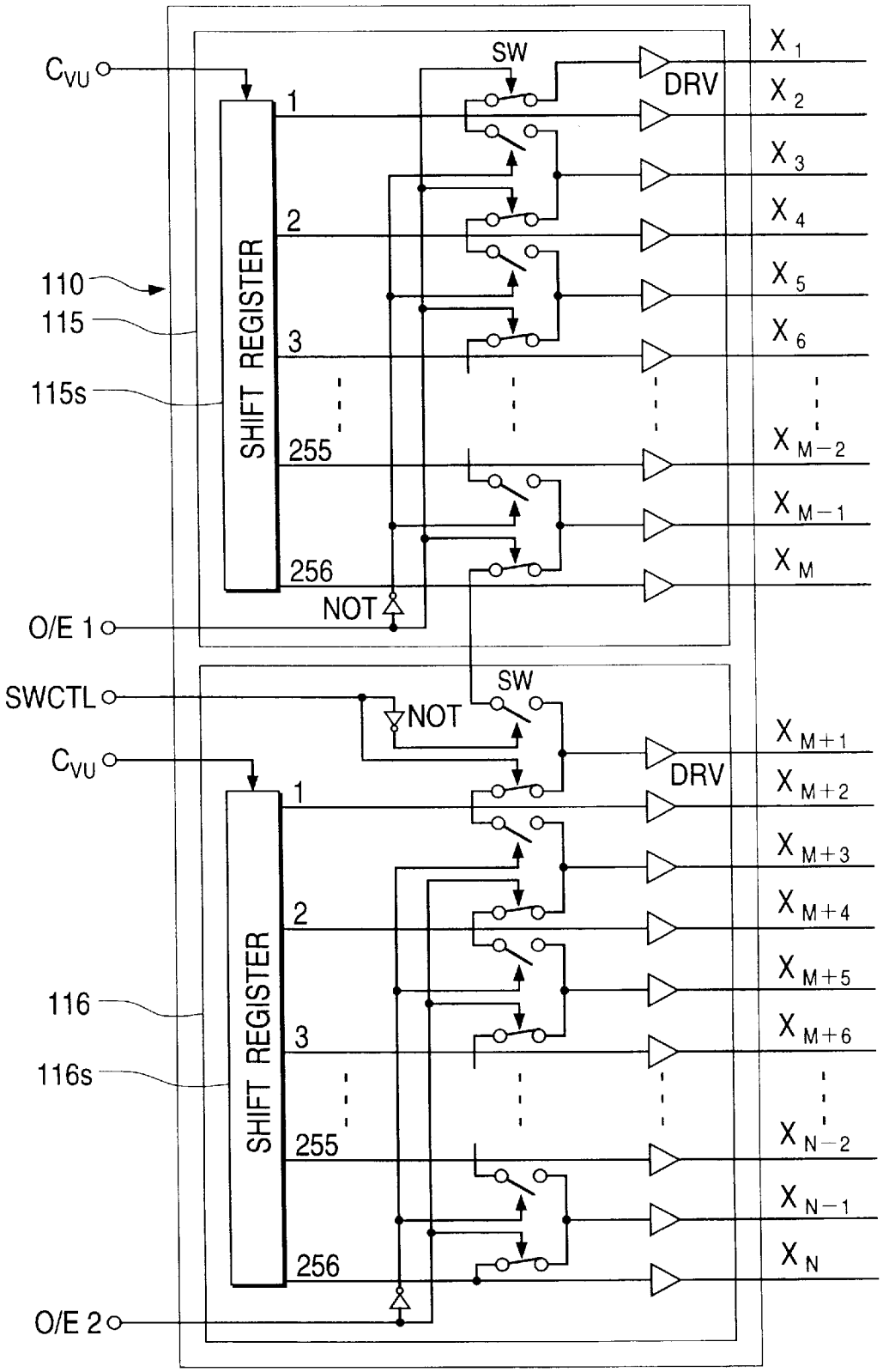
FIG. 18 is a block diagram of a scanning-electrode drive circuit in FIGS. 10 and 11.

As shown in FIG. 18, the scanning-electrode drive circuit 110 has the upper scanning-electrode drive circuit 115 and the lower scanning-electrode drive circuit 116. The scanning-electrode drive circuit 110 in FIG. 18 is designed for the case where the given numbers "M" and "N" are equal to 512 and 1,024 respectively.

As shown in FIG. 18, the upper scanning-electrode drive circuit 115 includes a shift register 115*s*, switches SW, an inverting circuit NOT, and drivers DRV. The shift register 115*s* receives the upper scanning-electrode control signal $C_{VU}$. The shift register 115*s* is of the 256-bit type having 256 output terminals. During every half-field interval, the shift register 115*s* sequentially outputs active pulses of 1-scanning-line durations (widths) via the output terminals in response to the upper scanning-electrode control signal $C_{VU}$. Even-numbered scanning electrodes $X_2, X_4, \ldots, X_M$ are connected to the output terminals of the shift register 115*s* via drivers DRV respectively. The first scanning electrode $X_1$ is connected to the first output terminal of the shift register 115*s* via a driver DRV and a switch SW. The third scanning electrode $X_3$ is connected to the first and second output terminals of the shift register 115*s* via drivers DRV and switches SW. Similarly, each of later odd-numbered scanning electrodes $X_5, X_7, \ldots, X_{M-1}$ is connected to two neighboring output terminals of the shift register 115*s* via drivers DRV and switches SW. The input terminal of the inverting circuit NOT receives the field change signal O/E1. Each of the switches SW has a control terminal subjected to the field change signal O/E1 or an output signal of the inverting circuit NOT. Accordingly, each of the switches SW is closed and opened in response to the field change signal O/E1 or the output signal of the inverting circuit NOT (the inversion of the field change signal O/E1). It should be noted that the drives DRV may be omitted from the upper scanning-electrode drive circuit 115.

As shown in FIG. 18, the lower scanning-electrode drive circuit 116 includes a shift register 116*s*, switches SW, inverting circuits NOT, and drivers DRV. The shift register 116*s* receives the lower scanning-electrode control signal $C_{VL}$. The shift register 116*s* is of the 256-bit type having 256 output terminals. During every half-field interval, the shift register 116*s* sequentially outputs active pulses of 1-scanning-line durations (widths) via the output terminals in response to the lower scanning-electrode control signal $C_{VL}$. Even-numbered scanning electrodes $X_{M+2}, X_{M+4}, \ldots, X_N$ are connected to the output terminals of the shift register 116*s* via drivers DRV respectively. The first scanning electrode $X_{M+1}$ is connected to the final output terminal of the shift register 115*a* in the upper scanning-electrode drive circuit 115 via a driver and the uppermost switch SW. The first scanning electrode $X_{M+1}$ is also connected to the first output terminal of the shift register 116*s* via a driver DRV and the second uppermost switch SW. The third scanning electrode $X_{M+3}$ is connected to the first and second output terminals of the shift register 116*s* via drivers DRV and switches SW. Similarly, each of later odd-numbered scanning electrodes $X_{M+5}, X_{M+7}, \ldots, X_{N-1}$ is connected to two neighboring output terminals of the shift register 115*s* via drivers DRV and switches SW. The input terminal of the lower inverting circuit NOT receives the field change signal O/E2. Each of the switches SW except the uppermost switch SW and the second uppermost switch SW has a control terminal subjected to the field change signal O/E2 or an output signal of the lower inverting circuit NOT. Accordingly, each of the switches SW except the uppermost switch SW and the second uppermost switch SW is closed and opened in response to the field change signal O/E2 or the output signal of the lower inverting circuit NOT (the inversion of the field change signal O/E2). The input terminal of the higher inverting circuit NOT receives the set control signal SWCTL. The uppermost switch SW has a control terminal subjected to an output signal of the higher inverting circuit NOT. The second uppermost switch SW has a control terminal subjected to the set control signal SWCTL. The set control signal SWCTL remains fixed in a given state so that the uppermost switch SW continues to be open while the second uppermost switch SW continues to be closed. Accordingly, the first scanning electrode $X_{M+1}$ remains connected to the first output terminal of the shift register 116*s* via the driver DRV. It should be noted that the drives DRV may be omitted from the lower scanning-electrode drive circuit 116.

The field change signal O/E1 fed to the upper scanning-electrode drive circuit 115 periodically changes between a high level and a low level as shown in the portion O/E1 of FIG. 15. The field change signal O/E1 has a period corresponding to two fields. The field change signal O/E2 fed to the lower scanning-electrode drive circuit 116 periodically changes between a high level and a low level as shown in the portion O/E2 of FIG. 15. The field change signal 0/E2 has a period corresponding to two fields. The field change signals O/E1 and 0/E2 are out of phase with respect to each other. The phase difference between the field change signals O/E1 and O/E2 corresponds to a half of a field.

Figure 17:
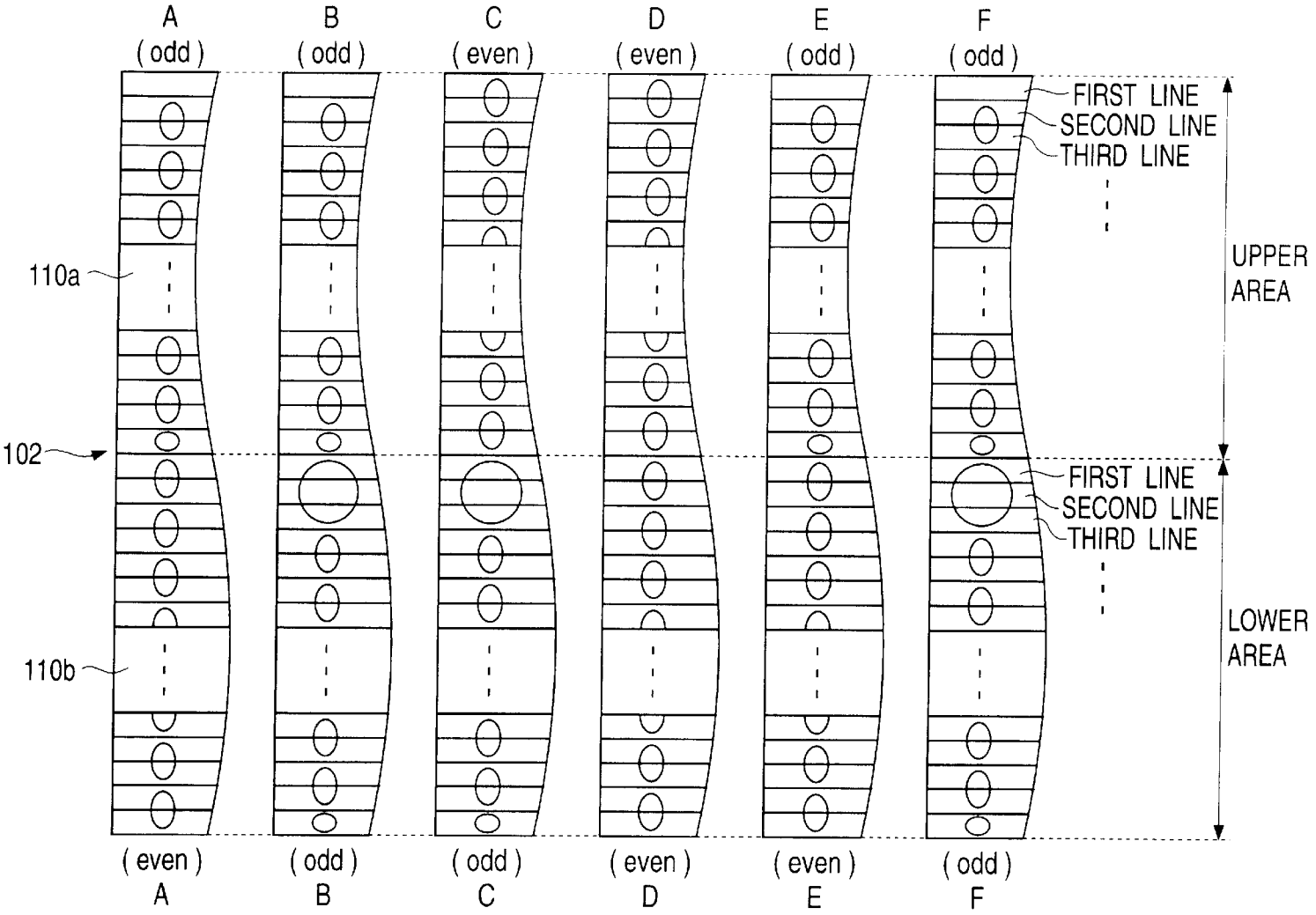
FIG. 17 is another time-domain diagram of conditions of the liquid-crystal display panel in FIGS. 10 and 11.

With reference to FIGS. 15, 17, and 18, during the former half of a first 1-field interval which corresponds to the time range A in FIG. 15 and the portion A of FIG. 17, the field change signal O/E1 is in a low-level state so that the scanning electrodes in the upper half 110*a* of the liquid-crystal display panel 102 are separated into sets as $(X_2, X_3)$, $(X_4, X_5)$, . . . , $(X_{M-2}, X_{M-1})$, $(X_M)$ which are connected to the output terminals of the shift register 115*s* respectively. Accordingly, these sets are sequentially activated to implement a vertical scanning process. In this case, the first scanning electrode (the uppermost scanning electrode) $X_1$ remains disconnected from the shift register 115*s*, and hence continues to be inactive. During the former half of the first 1-field interval, the field change signal O/E2 is in a high-level state so that the scanning electrodes in the lower half 110*b* of the liquid-crystal display panel 102 are separated into sets as $(X_{M+1}, X_{M+2})$, $(X_{M+3}, X_{M+4})$, . . . , $(X_{N-1}, X_N)$ which are connected to the output terminals of the shift register 116*s* respectively. Accordingly, these sets are sequentially activated to implement a vertical scanning process.

During the latter half of the first 1-field interval which corresponds to the time range B in FIG. 15 and the portion B of FIG. 17, the field change signal O/E1 is in the low-level state so that the scanning electrodes in the upper half 110*a* of the liquid-crystal display panel 102 are separated into sets as $(X_2, X_3)$, $(X_4, X_5)$, . . . , $(X_{M-2}, X_{M-1})$, $(X_M)$ which are connected to the output terminals of the shift register 115*s* respectively. Accordingly, these sets are sequentially activated to implement a vertical scanning process. In this case, the first scanning electrode (the uppermost scanning electrode) $X_1$ remains disconnected from the shift register 115*s*, and hence continues to be inactive. During the latter half of the first 1-field interval, the field change signal O/E2 is in a low-level state so that the scanning electrodes in the lower half 110*b* of the liquid-crystal display panel 102 are separated into sets as $(X_{M+1}, X_{M+2}, X_{M+3})$, $(X_{M+4}, X_{M+5})$, $(X_{M+6}, X_{M+7})$, . . . , $(X_{N-2}, X_{N-1})$, $(X_N)$ which are connected to the output terminals of the shift register 116*s* respectively. Accordingly, these sets are sequentially activated to implement a vertical scanning process.

During the former half of a second 1-field interval which corresponds to the time range C in FIG. 15 and the portion C of FIG. 17, the field change signal O/E1 is in a high-level state so that the scanning electrodes in the upper half 110*a* of the liquid-crystal display panel 102 are separated into sets as $(X_1, X_2)$, $(X_3, X_4)$, . . . , $(X_{M-1}, X_M)$ which are connected to the output terminals of the shift register 115*s* respectively. Accordingly, these sets are sequentially activated to implement a vertical scanning process. During the former half of the second 1-field interval, the field change signal O/E2 is in the low-level state so that the scanning electrodes in the lower half 110*b* of the liquid-crystal display panel 102 are separated into sets as $(X_{M+1}, X_{M+2}, X_{M+3})$, $(X_{M+4}, X_{M+5})$, $(X_{M+6}, X_{M+7})$, . . . , $(X_{N-2}, X_{N-1})$, $(X_N)$ which are connected to the output terminals of the shift register 116*s* respectively. Accordingly, these sets are sequentially activated to implement a vertical scanning process.

During the latter half of the second 1-field interval which corresponds to the time range D in FIG. 15 and the portion D of FIG. 17, the field change signal O/E1 is in the high-level state so that the scanning electrodes in the upper half 110*a* of the liquid-crystal display panel 102 are separated into sets as $(X_1, X_2)$, $(X_3, X_4)$, . . . , $(X_{M-1}, X_M)$ which are connected to the output terminals of the shift register 115*s* respectively. Accordingly, these sets are sequentially activated to implement a vertical scanning process. During the latter half of the second 1-field interval, the field change signal O/E2 is in the high-level state so that the scanning electrodes in the lower half 110*b* of the liquid-crystal display panel 102 are separated into sets as $(X_{M+1}, X_{M+2})$, $(X_{M+3}, X_{M+4})$, . . . , $(X_{N-1}, X_N)$ which are connected to the output terminals of the shift register 116*s* respectively. Accordingly, these sets are sequentially activated to implement a vertical scanning process.

What is claimed is:

1. A liquid-crystal display apparatus comprising:

a layer of liquid crystal;

a matrix array of scanning electrodes and signal electrodes, the scanning electrodes extending along a matrix row direction, the signal electrodes extending along a matrix column direction;

switching circuit elements located at respective places where the scanning electrodes intersect with the signal electrodes;

pixel electrodes connected to the switching circuit elements for controlling portions of the liquid-crystal layer respectively;

first means for feeding a video signal, corresponding to a former half of a 1-field interval, to an upper half of the signal electrodes;

second means for feeding a video signal, corresponding to a latter half of a 1-field interval, to a lower half of the signal electrodes;

third means for making opposite a polarity of the video signal fed by the first means and a polarity of the video signal fed by the second means with respect to each other;

fourth means for sequentially driving the scanning electrodes corresponding to the upper half of the signal electrodes from the uppermost scanning electrode for every half-field interval; and fifth means for sequentially driving the scanning electrodes corresponding to the lower half of the signal electrodes from the uppermost scanning electrode for every half-field interval.

2. A liquid-crystal display apparatus comprising:

a layer of liquid crystal;

a matrix array of scanning electrode and signal electrodes, the scanning electrodes extending along a matrix row direction, the signal electrodes extending along a matrix column direction;

switching circuit elements located at respective places where the scanning electrodes intersect with the signal electrodes;

pixel electrodes connected to the switching circuit elements for controlling portions of the liquid-crystal layer respectively;

first means for feeding a video signal, corresponding to a former half of a 1-field interval, to an upper half of the signal electrodes;

second means for feeding a video signal, corresponding to a latter half of a 1-field interval, to a lower half of the signal electrodes;

third means for making opposite a polarity of the video signal fed by the first means and a polarity of the video signal fed by the second means with respect to each other;

fourth means for sequentially driving the scanning electrodes corresponding to the upper half of the signal electrodes from the uppermost scanning electrode for every half-field interval; and fifth means for sequentially driving the scanning electrodes corresponding to the lower half of the signal electrodes from the uppermost scanning electrode for every half-field interval;

the fourth means being operative to, in cases where a video signal corresponding to an even-numbered scanning line is fed to the upper half of the signal electrodes by the first means, sequentially drive a set having the first scanning electrode and the second scanning electrode, and sets of each having an odd-numbered scanning electrode and a next even-numbered scanning electrode;

the fifth means being operative to, in cases where a video signal corresponding to an even-numbered scanning line is fed to the lower half of the signal electrodes by the second means, sequentially drive a set having the first scanning electrode and the second scanning electrode, and sets each having an odd-numbered scanning electrode and a next even-numbered scanning electrode;

the fourth means being operative to, in cases where a video signal corresponding to an odd-numbered scanning line is fed to the upper half of the signal electrodes by the first means, sequentially drive sets each having an even-numbered scanning electrode and a next odd-numbered scanning electrode;

the fifth means being operative to, in cases where a video signal corresponding to an odd-numbered scanning line is fed to the lower half of the signal electrodes by the second means, sequentially drive a set having the first scanning electrode, the second scanning electrode, and the third scanning electrode, and sets each having an even-numbered scanning electrode and a next odd-numbered scanning electrode.

3. A liquid-crystal display apparatus comprising:

a liquid-crystal layer having first and second half areas;

first means for, during a former half of a first 1-field time interval, feeding a first video signal segment of a positive polarity to the first half area of the liquid-crystal layer;

second means for inverting the first video signal segment of the positive polarity into the first video signal segment of a negative polarity;

third means for, during a latter half of the first 1-field time interval, feeding the first video signal segment of the negative polarity to the first half area of the liquid-crystal layer;

fourth means for, during the latter half of the first 1-field time interval, feeding a second video signal segment of a positive polarity to the second half area of the liquid-crystal layer;

fifth means for inverting the second video signal segment of the positive polarity into the second video signal segment of a negative polarity; and sixth means for, during a former half of a second 1-field time interval, feeding the second video signal segment of the negative polarity to the second half area of the liquid-crystal layer.

4. A liquid-crystal display apparatus comprising:

a liquid-crystal layer having first and second half areas, the first half area having parallel lines, the second half area having parallel lines;

first means for separating the lines in the first half area of the liquid-crystal layer into sets each having one line or two neighboring lines;

second means for separating the lines in the first half area of the liquid-crystal layer into sets each having two neighboring lines, wherein the line sets provided by the second means differ from the line sets provided by the first means;

third means for separating the lines in the second half area of the liquid-crystal layer into sets each having two neighboring lines;

fourth means for separating the lines in the second half area of the liquid-crystal layer into sets each having one line, two neighboring lines, or three neighboring lines, wherein the line sets provided by the fourth means differ from the line sets provided by the third means;

fifth means for, during a former half of a first 1-field time interval, sequentially feeding a first video signal segment of a positive polarity to the line sets provided by the first means;

sixth means for, during the former half of the first 1-field time interval, sequentially feeding a second video signal segment of a negative polarity to the line sets provided by the third means;

seventh means for inverting the first video signal segment of the positive polarity into the first video signal segment of a negative polarity;

eighth means for, during a latter half of the first 1-field time interval, sequentially feeding the first video signal segment of the negative polarity to the line sets provided by the first means;

ninth means for, during the latter half of the first 1-field time interval, sequentially feeding a third video signal segment of a positive polarity to the line sets provided by the fourth means;

tenth means for inverting the third video signal segment of the positive polarity into the third video signal segment of a negative polarity;

eleventh means for, during a former half of a second 1-field time interval, sequentially feeding the third video signal segment of the negative polarity to the line sets provided by the fourth means;

twelfth means for, during the former half of the second 1-field time interval, sequentially feeding a fourth video signal segment of a positive polarity to the line segments provided by the second means;

thirteenth means for causing one of the line sets provided by the third means and one of the line sets provided by the fourth means to contain a first end line among the lines in the second half area of the liquid-crystal layer which adjoins a boundary between the first and second half areas of the liquid-crystal layer so that the first end line continues to be fed with video information represented by the second video signal segment or the third video signal segment; and fourteenth means for causing one of the line sets provided by the first means and one of the line sets provided by the second means to contain a second end line among the lines in the first half area of the liquid-crystal layer which adjoins a boundary between the first and second half areas of the liquid-crystal layer so that the second end line continues to be fed with video information represented by the first video signal segment or the fourth video signal segment.

* * * * *